US012410374B2

(12) United States Patent
Narita

(10) Patent No.: US 12,410,374 B2
(45) Date of Patent: Sep. 9, 2025

(54) LUBRICATING OIL COMPOSITION, LUBRICATION METHOD, AND TRANSMISSION

(71) Applicant: IDEMITSU KOSAN CO., LTD., Tokyo (JP)

(72) Inventor: Keiichi Narita, Chiba (JP)

(73) Assignee: IDEMITSU KOSAN CO., LTD., Tokyo (JP)

( * ) Notice: Subject to any disclaimer, the term of this patent is extended or adjusted under 35 U.S.C. 154(b) by 0 days.

(21) Appl. No.: 18/696,606

(22) PCT Filed: Sep. 16, 2022

(86) PCT No.: PCT/JP2022/034818
§ 371 (c)(1),
(2) Date: Mar. 28, 2024

(87) PCT Pub. No.: WO2023/058440
PCT Pub. Date: Apr. 13, 2023

(65) Prior Publication Data

US 2024/0384193 A1 Nov. 21, 2024

(30) Foreign Application Priority Data

Oct. 4, 2021 (JP) ..... 2021-163666

(51) Int. Cl.

| | |
|---|---|
| ***C10M 101/02*** | (2006.01) |
| ***C10M 107/02*** | (2006.01) |
| ***C10M 107/32*** | (2006.01) |
| *C10M 137/04* | (2006.01) |
| *C10N 20/02* | (2006.01) |
| *C10N 20/04* | (2006.01) |
| *C10N 30/06* | (2006.01) |
| *C10N 40/04* | (2006.01) |

(52) U.S. Cl.
CPC ..... *C10M 101/02* (2013.01); *C10M 107/02* (2013.01); *C10M 107/32* (2013.01); *C10M 137/04* (2013.01); *C10M 2203/1025* (2013.01); *C10M 2209/1023* (2013.01); *C10M 2223/04* (2013.01); *C10N 2020/02* (2013.01); *C10N 2020/04* (2013.01); *C10N 2030/06* (2013.01); *C10N 2040/04* (2013.01)

(58) Field of Classification Search
CPC C10M 101/02; C10M 107/02; C10M 107/32; C10M 137/04; C10M 2203/1025; C10M 2209/1023; C10M 2223/04; C10N 2020/02; C10N 2020/04; C10N 2030/06; C10N 2040/04
USPC ..... 508/349
See application file for complete search history.

(56) References Cited

U.S. PATENT DOCUMENTS

| | | | | |
|---|---|---|---|---|
| 2004/0132629 | A1* | 7/2004 | Vinci | C10M 169/044 508/591 |
| 2013/0317265 | A1 | 11/2013 | Small et al. | |
| 2015/0051124 | A1* | 2/2015 | Takekawa | C10M 101/02 208/18 |
| 2015/0376544 | A1* | 12/2015 | Nakao | C10M 169/04 508/192 |
| 2016/0257905 | A1 | 9/2016 | Komatsubara et al. | |
| 2019/0024016 | A1 | 1/2019 | Narita | |
| 2019/0359744 | A1 | 11/2019 | Chen et al. | |
| 2022/0411710 | A1 | 12/2022 | Shono et al. | |

FOREIGN PATENT DOCUMENTS

| | | | |
|---|---|---|---|
| EP | 3 342 845 | A1 | 4/2018 |
| JP | 2009-292997 | A | 12/2009 |
| JP | 2011-225661 | A | 11/2011 |
| JP | 2014-159496 | A | 9/2014 |
| JP | 2016-190918 | A | 11/2016 |
| JP | 2017-145399 | A | 8/2017 |
| JP | 2018-109163 | A | 7/2018 |
| JP | 2021-147507 | A | 9/2021 |
| WO | WO 2004/069967 | A1 | 8/2004 |
| WO | WO 2021/100634 | A1 | 5/2021 |

OTHER PUBLICATIONS

International Search Report and Written Opinion issued Nov. 1, 2022, in PCT/JP2022/034818 (with English Translation), 14 pages.
Roegiers Michel et al. "Property blending relationships for binary mixtures of mineral oil and elektrionised vegetable oil: viscosity, solvent power, and seal compatibility index," Lubrication Science, vol. 23, No. 6, Apr. 19, 2011, pp. 263-278, DOI: 10.1002/bis/ls.154 Retrieved from the Internet: URL: http://www.sveacon.se/LS_2011.pdf.
Official communication issued in EP application 22878311.4 on Jul. 23, 2025.

* cited by examiner

*Primary Examiner* — Prem C Singh
*Assistant Examiner* — Francis C Campanell
(74) *Attorney, Agent, or Firm* — Oblon, McClelland, Maier &Neustadt, L.L.P.

(57) ABSTRACT

A lubricating oil composition that satisfies the fuel efficiency with a low viscosity and a low traction coefficient, the wear resistance, the usability with a high flash point, and the low temperature fluidity, at high levels, having a base oil having a kinematic viscosity at 40° C. of 3.000 $mm^2/s$ or more and 20.000 $mm^2/s$ or less as a component (A); and a base oil having a kinematic viscosity at 40°° C. of 100.000 $mm^2/s$ or more and 2000.000 $mm^2/s$ or less as a component (B), the component (A) having a flash point of 180° C. or more, the lubricating oil composition having a content of the component (B) of 0.01% by mass or more and 2.00% by mass or less based on the total amount of the lubricating oil composition, a lubricating method using the same, and a transmission including the same.

19 Claims, No Drawings

LUBRICATING OIL COMPOSITION, LUBRICATION METHOD, AND TRANSMISSION

CROSS REFERENCE TO RELATED APPLICATIONS

This application is a National Stage entry under 35 U.S.C. § 371 of PCT/JP2022/034818, filed on Sep. 16, 2022, and claims priority to JP Patent Application No. 2021-163666, filed on Oct. 4, 2021, the entire contents of which are incorporated herein by reference.

TECHNICAL FIELD

The present invention relates to a lubricating oil composition, a lubricating method using the lubricating oil composition, and a transmission including the lubricating oil composition.

BACKGROUND ART

A driving system apparatus such as a damper, a transmission and a power steering, which is used in automobiles such as four-wheel vehicles and two-wheel vehicles, earthquake-resistant mechanisms of residential houses, and the like, includes such components as a plain bearing, a piston ring, and a lubricating oil composition is used for lubricating the sliding parts of the components.

In view of the environmental considerations becoming an issue in recent years, there is an increasing demand for further improvement in fuel efficiency of vehicles, such as automobiles. One of the measures for the improvement in fuel efficiency is a method of reducing the viscosity of the transmission lubricating oil composition used in transmissions and the like, and thereby reducing the agitation resistance.

With the spread of hybrid automobiles and electric automobiles, the lubricating oil compositions for the automobiles are demanded to have capabilities that can be used for multiple applications. In the hybrid automobiles and electric automobiles, the lubricating oil composition is demanded to have capabilities that not only can be used in a transmission, but also can be used for cooling and lubricating an electric motor, a reducer, and the like.

Further, lubricating oil compositions used in dampers are demanded to have the capability of lubricating the sliding parts of the components in the dampers, and also demanded to have a capability of attenuating vibration from the road surface to the vehicle body in the case of a damper for automobiles, or vibration of earthquake or the like in the case of a damper for houses, in such a mechanism that the lubricating oil composition is charged inside the damper and causes a fluid resistance in expanding and contracting the piston.

In any application, the lubricating oil compositions are demanded to achieve both the fuel efficiency and the wear resistance simultaneously. As a lubricating oil composition that achieves both of them simultaneously, PTLs 1 to 3 propose lubricating oil compositions. For reducing the viscosity and improving the wear resistance, with a combination of multiple kinds of base oils, investigations have been made for the addition of a phosphorus based extreme pressure agent (PTL 1) or the addition of a phosphite ester (PTL 2) to the base oil. Investigations have also been made for the use of a base oil including a combination of multiple kinds of mineral oils and synthetic oils (PTL 3).

CITATION LIST

Patent Literatures

PTL 1: WO 2004/069967
PTL 2: JP 2014-159496 A
PTL 3: JP 2009-292997 A

SUMMARY OF INVENTION

Technical Problem

Investigations have been made for achieving low viscosity of lubricating oils as one measure for the fuel efficiency. However, in general, the reduction of the viscosity of the lubricating oil considerably decreases the oil film forming capability due to the decrease of the viscosity in a high temperature range. As a result, the wear of the sliding components and the like of the transmission easily occurs, which results in not only failure of the fuel efficiency, but also decrease in durability of the transmission.

The reduction in traction coefficient is also effective for the fuel efficiency of the transmission. The lubricating oil composition used in the transmission has the relationship in which a large traction coefficient is demanded for securing a large torque transmission capacity, but a large traction coefficient deteriorates the fuel efficiency. The use of a base oil having high viscosity is effective for increasing the traction coefficient of the lubricating oil composition, but the increase of the content of the base oil having high viscosity in the lubricating oil deteriorates the low temperature fluidity. For example, the lubricating oil composition used in the transmission is required to secure excellent fluidity at a low temperature assuming the use in the cold areas, such as North Europe and North America. The fluidity at a low temperature can be evaluated by the Brookfield viscosity (BF viscosity) at −40° C., and the increase of the traction coefficient as described above increases the BF viscosity at −40° C., deteriorating the fluidity at a low temperature. The BF viscosity at −40° C. can be an index of the low temperature fluidity, and the smaller the value thereof is, the better the low temperature fluidity is.

As described above, for achieving the fuel efficiency with a low viscosity and a low traction coefficient, the balance between the capabilities, such as the wear resistance, and the low temperature fluidity is important.

In addition, the use of a base oil having low viscosity for reducing the viscosity also tends to decrease the flash point. In the case where the transmission or the like is cooled with the lubricating oil composition, the temperature of the lubricating oil composition is increased in some cases due to the heat generated in the part to be cooled, and the low flash point of the lubricating oil composition used brings about the risk of flash of the generated vapor. Accordingly, the lubricating oil composition used in the transmission is also demanded to have an improved usability with a high flash point.

Above-mentioned PTL 1 investigates the combination of base oils and high viscosity lubricating oils, and the like for reducing the low viscosity and improving the fatigue life characteristics, but selects the base oils and the high viscosity lubricating oils based on the kinematic viscosity at 100° C., and for the lubricating oil compositions, investigates only the kinematic viscosities at 40° C. and 100° C., and the fluidity at a low temperature, such as the BF viscosity at −40° C., is not confirmed thereby. Furthermore, the volatile component contained in the base oil is also not investigated, and there is no description about the flash point.

PTL 2 investigates the combination of mineral oil based base oils and monoester based base oils for improving the fuel efficiency and the metal fatigue prevention capability of a transmission, and the heat resistance. As similar to PTL 1, the base oil is selected based on the kinematic viscosity at 100° C. Furthermore, the lubricating oil compositions described in the examples all have a high BF viscosity at −40° C. due to the use of the monoester based base oil in an amount of 5% by mass or more, and there is a necessity to improve the flowability at a low temperature.

Above-described PTL 3 investigates the composition and the like of the base oil for improving the shearing stability, the high viscosity index, and the fuel efficiency characteristics. However, PTL 3 also investigates the base oil based on the kinematic viscosity at 100° C., and measures only the kinematic viscosity at 100° C. for the kinematic viscosity of the lubricating oil composition, but does not focus the fluidity at a low temperature and does not investigate the flash point.

The present invention has been made under the circumstances described above, and an object thereof is to provide a lubricating oil composition that satisfies the fuel efficiency with a low viscosity and a low traction coefficient, the wear resistance, the usability with a high flash point, and the low temperature fluidity, at high levels, a lubricating method using the same, and a transmission including the same.

Solution to Problem

For solving the problems described above, the present inventors provide the following items [1] to [3].

[1] A lubricating oil composition containing:

a base oil having a kinematic viscosity at 40° C. of 3.000 $mm^2/s$ or more and 20.000 $mm^2/s$ or less as a component (A); and a base oil having a kinematic viscosity at 40° C. of 100.000 $mm^2/s$ or more and 2000.000 $mm^2/s$ or less as a component (B), the component (A) having a flash point of 180° C. or more, and the lubricating oil composition having a content of the component (B) of 0.01% by mass or more and 2.00% by mass or less based on the total amount of the lubricating oil composition.

[2] A lubricating method including using the lubricating oil composition according to the item [1].

[3] A transmission including the lubricating oil composition according to the item [1].

Advantageous Effects of Invention

The present invention can provide a lubricating oil composition that satisfies the fuel efficiency with a low viscosity and a low traction coefficient, the wear resistance, the usability with a high flash point, and the low temperature fluidity, at high levels, a lubricating method using the same, and a transmission including the same.

DESCRIPTION OF EMBODIMENTS

An embodiment of the present invention (which may be hereinafter referred to as a "present embodiment") will be described below. In the description herein, the values of the upper limit and the lower limit of the numeral ranges described with "or more", "or less", and "to" are values that can be optionally combined, and the values in the examples can also be used as the values of the upper limit and the lower limit.

The lubricating oil compositions, the lubricating methods using the same, and the transmissions including the same of the present embodiment are only embodiments of the present invention, and the present invention is not limited thereto.

[Lubricating Oil Composition]

The lubricating oil composition of the present embodiment contains a base oil having a kinematic viscosity at 40° C. of 3.000 $mm^2/s$ or more and 20.000 $mm^2/s$ or less as a component (A), and a base oil having a kinematic viscosity at 40° C. of 100.000 $mm^2/s$ or more and 2000.000 $mm^2/s$ or less as a component (B), and it is necessary that the component (A) has a flash point of 180° C. or more, and the lubricating oil composition has a content of the component (B) of 0.01% by mass or more and 2.00% by mass or less based on the total amount of the lubricating oil composition.

In the description herein, the kinematic viscosity is a value that is measured with a glass capillary viscometer according to JIS K2283:2000.

In the description herein, the flash point means a value that is measured by the Cleveland open-cup (COC) method according to JIS K2265.

The lubricating oil composition can have a low viscosity and can achieve the lower traction coefficient by the effect of the component (A) having a kinematic viscosity at 40° C. in the particular range contained therein. Furthermore, the component (A) having a kinematic viscosity at 40° C. in the particular range can achieve the fuel efficiency with a low traction coefficient and the low temperature fluidity with a low BF viscosity at −40° C., while retaining the high flash point. In addition, the combination use of the component (B) having a kinematic viscosity at 40° C. in the particular range higher than the component (A) in the particular content can retain the oil film forming capability, can achieve the high wear resistance, and can achieve the low traction coefficient.

As described above, the lubricating oil composition of the present embodiment focuses the kinematic viscosities at a relatively low temperature, i.e., 40° C., of the component (A) and the component (B), and uses two kinds of base oils having the particular kinematic viscosities at 40° C. as the component (A) and the component (B) with the particular content of the component (B), and thereby while retaining the low temperature fluidity, the fuel efficiency (with a low viscosity and a low traction coefficient), the usability with a high flash point, and the wear resistance can be achieved at high levels with good balance, by complementing the capabilities of the the component (A) and the component (B) each other.

In the description herein, the "oil film forming capability" means the property or capability of the lubricating oil composition that can form an oil film covering the surface of the metal of the transmission to be lubricated, particularly the surface of the metal having fine unevenness thereon. A higher oil film forming capability can suppress the impact between metals, providing a high wear resistance.

In the description herein, the "usability with a high flash point" means the property of the lubricating oil composition that can be used in a high temperature condition without flash due to the high flash point thereof.

<Component (A): Base Oil (Low Kinematic Viscosity Base Oil)>

The lubricating oil composition of the present embodiment necessarily contains a base oil having a kinematic viscosity at 40° C. of 3.000 $mm^2/s$ or more and 20.000 $mm^2/s$ or less as the component (A). The component (A) and the component (B) described later are different from each other in kinematic viscosity at 40° C. In the following, the component (A) may be referred to as a low kinematic viscosity base oil, and the component (B) may be referred to as a high kinematic viscosity base oil, in some cases.

The combination of the components (A) and (B) different from each other in kinematic viscosity at 40° C. and the particular content of the component (B) contained therein realize the lubricating oil composition that satisfies the fuel efficiency and the low temperature fluidity at high levels while retaining the wear resistance and the high flash point. In the present embodiment, the kinematic viscosities at a low temperature, i.e., 40° C., are focused for improving the low temperature fluidity, based on which the the component (A) and the component (B) are defined.

The kinematic viscosity at 40° C. ($V_{40}$) of the component (A) is preferably the upper limit value described below or less for achieving the fuel efficiency with a low viscosity and a low traction coefficient and the low temperature fluidity with a low BF viscosity at −40° C. in combination with the component (B) described later, is preferably the lower limit value described below or more for achieving the high flash point, and is preferably 5.000 $mm^2/s$ or more and 15.000 $mm^2/s$ or less, more preferably 8.000 $mm^2/s$ or more and 13.000 $mm^2/s$ or less, further preferably 9.000 $mm^2/s$ or more and 11.000 $mm^2/s$ or less, still further preferably 9.200 $mm^2/s$ or more and 10.000 $mm^2/s$ or less, and particularly preferably 9.400 $mm^2/s$ or more and 9.950 $mm^2/s$ or less.

For achieving the fuel efficiency and the low temperature fluidity by the combination with the component (B) described later, the kinematic viscosity at a low temperature, i.e., 40° C., of the component (A) is important. However, the temperature of the lubricating oil composition is increased depending on the use condition, and therefore the lubricating oil composition necessarily retains the oil film forming capability at a high temperature for achieving the high wear resistance and the fuel efficiency. The component (B) described later is important for retaining the oil film forming capability at a high temperature, but an increased content of the component (B) is not preferred from the standpoint of the low viscosity, the low traction coefficient, and the low BF viscosity at −40° C. Accordingly, the kinematic viscosity at 100° C. ($V_{100}$) of the component (A) is preferably 1.000 $mm^2/s$ or more and 10.000 $mm^2/s$ or less, more preferably 1.500 $mm^2/s$ or more and 5.000 $mm^2/s$ or less, further preferably 2.000 $mm^2/s$ or more and 3.000 $mm^2/s$ or less, still further preferably 2.500 $mm^2/s$ or more and 2.900 $mm^2/s$ or less, and particularly preferably 2.600 $mm^2/s$ or more and 2.800 $mm^2/s$ or less, for decreasing the content of the component (B).

In the lubricating oil composition of the present embodiment, the component (A) necessarily has a flash point of 180° C. or more. The component (B) described later has a higher flash point than the component (A), and therefore the flash point of the lubricating oil composition is dominated by the flash point of the component (A). The flash point of the component (A) is preferably the upper limit value described below or less for increasing the flash point of the lubricating oil composition, is preferably the lower limit value described below or more for improving the fuel efficiency and the low temperature fluidity, and is preferably 180° C. or more and 210° C. or less, more preferably 182° C. or more and 208° C. or less, further preferably 184° C. or more and 205° C. or less, still further preferably 185° C. or more and 200° C. or less, and particularly preferably 185° C. or more and 195° C. or less.

The mass average molecular weight (Mw) of the component (A) can be appropriately selected for allowing the flash point to be within the aforementioned range, and is preferably 200 or more and 1,000 or less for achieving the wear resistance while retaining the low viscosity and the low traction coefficient of the lubricating oil composition. The mass average molecular weight (Mw) thereof is preferably the lower limit value described later or more for improving the flash point, is preferably the upper limit value described below or less for retaining the oil film forming capability with the component (B) described later, achieving the low traction coefficient, and achieving the low temperature fluidity, and is more preferably 250 or more and 800 or less, further preferably 280 or more and 500 or less, still further preferably 300 or more and 400 or less, and particularly preferably 300 or more and 350 or less.

In the description herein, Mw can be determined, for example, by the method described in the examples.

The pour point of the component (A) is preferably the upper limit value described below or less for achieving the low temperature fluidity, in which the lower limit value thereof is not preferably limited and is preferably the lower limit value described below or more for retaining the oil film forming capability with the component (B), and is preferably −50° C. or more and −20° C. or less, more preferably −48° C. or more and −30°° C. or less, and further preferably −45° C. or more and −38° C. or less.

In the description herein, the pour point is a value that is measured according to the pour point test method defined in JIS K2269 (Testing Methods for Pour Point and Cloud Point of Crude Oil and Petroleum Products).

The viscosity index (VI) of the component (A) is preferably 100 or more and 130 or less, more preferably 105 or more and 120 or less, and further preferably 108 or more and 115 or less, for improving the low temperature fluidity and the oil film forming capability.

In the description herein, the kinematic viscosity and the viscosity index are values that are measured with a glass capillary viscometer according to JIS K2283:2000.

The density at 15° C. of the component (A) used in the lubricating oil composition of the present embodiment is preferably 0.860 $g/cm^3$ or less, more preferably 0.850 $g/cm^3$ or less, further preferably 0.840 $g/cm^3$ or less, still further preferably 0.830 $g/cm^3$ or less, and particularly preferably 0.825 $g/cm^3$ or less, and is generally 0.800 $g/cm^3$ or more.

In the case where the component (A) has a density at 15° C. of 0.860 $g/cm^3$ or less, the base oil can have a low temperature dependency of the viscosity and a higher flash point.

Note that, in the description herein, the density at 15° C. is a value that is measured according to JIS K2249.

The content of the component (A) is preferably 80.00% by mass or more and 99.00% by mass or less, more preferably 85.00% by mass or more and 98.00% by mass or less, further preferably 87.00% by mass or more and 95.00% by mass or less, still further preferably 90.00% by mass or more and 93.00% by mass or less, and particularly preferably 90.10% by mass or more and 91.50% by mass or less, based on the total amount of the composition.

The component (A) may be a base oil having a kinematic viscosity at 40° C. of 3.000 $mm^2/s$ or more and 20.000 $mm^2/s$ or less, which may be any of a mineral oil, a synthetic oil, and a mixed oil of a mineral oil and a synthetic oil, and is preferably a mineral oil.

(Mineral Oil)

The mineral oil is not particularly limited, as far as having a kinematic viscosity at 40° C. of 3.000 $mm^2/s$ or more and 20.000 $mm^2/s$ or less, and examples thereof include an atmospheric residual oil obtained through atmospheric distillation of a crude oil, such as a paraffin based crude oil, an intermediate based crude oil, and a naphthene based crude oil; a distillated oil obtained through vacuum distillation of the atmospheric residual oil; and a mineral oil obtained by subjecting the distillated oil to one or more of a refining treatment, such as solvent deasphalting, solvent extraction, hydrocracking, solvent dewaxing, catalytic dewaxing, and hydrorefining.

Furthermore, the mineral oil used is preferably an oil that is classified into any of Groups II and III of the base oil category of API (American Petroleum Institute) from the standpoint of achieving the low friction coefficient and enhancing the copper corrosion resistance.

In the case where the component (A) used in the lubricating oil composition of the present embodiment is a mineral oil, the paraffin content (% $C_P$) thereof is preferably 84% or more, and is more preferably 84.5% or more and 98% or less, further preferably 85% or more and 95% or less, still further preferably 86% or more and 93% or less, and particularly preferably 86.5% or more and 91% or less, for achieving the fuel efficiency and the high flash point.

The naphthene content (% $C_N$) thereof is preferably 3% or more and 40% or less, more preferably 5% or more and 30% or less, further preferably 8% or more and 20% or less, and still further preferably 9% or more and 15% or less.

The aromatic content (% $C_A$) thereof is preferably less than 2.0%, more preferably less than 1.0%, and further preferably less than 0.5%. The lower limit value thereof is not particularly limited.

Note that, in the description herein, the paraffin content (% $C_P$), the naphthene content (% $C_N$), and the aromatic content (% $C_A$) mean the proportions (percentage) of the paraffin component, the naphthene component, and the aromatic component, respectively, that are measured by the ring analysis (n-d-M method) of ASTM D3238.

The flash point of the mineral oil is preferably 180° C. or more and 210° C. or less, more preferably 182° C. or more and 200° C. or less, further preferably 184° C. or more and 197° C. or less, still further preferably 185° C. or more and 196° C., and particularly preferably 182° C. or more and 195° C. or less.

In the case where the component (A) used in the lubricating oil composition of the present embodiment is a mineral oil, the aniline point thereof is preferably 70° C. or more, more preferably 80° C. or more, further preferably 85° C. or more, and still further preferably 90° C. or more, and is generally 110° C. or less.

A mineral oil having an aniline point of 70° C. or more tends to have a large paraffin content and a small aromatic content, and thereby a high flash point can be easily obtained.

In the description herein, the aniline point means a value that is measured according to JIS K2265 (U-tube method).

The content of the mineral oil is preferably 80.00% by mass or more and 99.00% by mass or less, more preferably 85.00% by mass or more and 98.00% by mass or less, further preferably 87.00% by mass or more and 95.00% by mass or less, still further preferably 90.00% by mass or more and 93.00% by mass or less, and particularly preferably 90.10% by mass or more and 91.50% by mass or less, based on the total amount of the composition.

In the case where the component (A) used is a mineral oil, the density at 15° C. or the mineral oil is preferably 0.800 $g/cm^3$ or more and 0.860 $g/cm^3$ or less, more preferably 0.800 $g/cm^3$ or more and 0.850 $g/cm^3$ or less, further preferably 0.800 $g/cm^3$ or more and 0.840 $g/cm^3$ or less, still further preferably 0.800 $g/cm^3$ or more and 0.830 $g/cm^3$ or less, and particularly preferably 0.800 $g/cm^3$ or more and 0.825 $g/cm^3$ or less.

The content of the mineral oil as the component (A) is preferably 80.00% by mass or more and 100.00% by mass or less, preferably 90.00% by mass or more and 100.00% by mass or less, and preferably 95.00% by mass or more and 100.00% by mass or less, based on the total amount of the component (A) used in the lubricating oil composition of the present embodiment, and it is preferred that the component (A) is constituted substantially only by the mineral oil (100.00% by mass).

(Synthetic Oil)

The synthetic oil used may be one of the various synthetic oils described as the synthetic oil for the component (B) later alone or a combination of multiple kinds thereof, as far as having a kinematic viscosity at 40° C. of 3.000 $mm^2/s$ or more and 20.000 $mm^2/s$ or less.

The properties of the synthetic oil other than the kinematic viscosity at 40° C. are not particularly limited, as far as having a kinematic viscosity at 40° C. within the aforementioned range, and for example, a synthetic oil that has a flash point, an aniline point, and a density within numeral ranges equivalent to those described for the properties of the mineral oil above can easily have a kinematic viscosity at 40° C. within the aforementioned range.

Component (B): Base Oil (High Kinematic Viscosity Base Oil)

The lubricating oil composition of the present embodiment necessarily contains a base oil having a kinematic viscosity at 40° C. of 100.000 $mm^2/s$ or more and 2000.000 $mm^2/s$ or less as the component (B).

The upper limit value of the kinematic viscosity at 40° C. ($V_{40}$) of the component (B) is preferably the upper limit value described below or less for retaining the oil film forming capability and achieving the high wear resistance in combination with the component (A), is preferably the lower limit value described below or more for achieving the fuel efficiency and the low temperature fluidity; and is preferably 150.000 $mm^2/s$ or more and 1800.000 $mm^2/s$ or less, more preferably 180.000 $mm^2/s$ or more and 1750.000 $mm^2/s$ or less, further preferably 200.000 $mm^2/s$ or more and 1700.000 $mm^2/s$ or less, and particularly preferably 250.000 $mm^2/s$ or more and 1650.000 $mm^2/s$ or less.

The kinematic viscosity at 100° C. ($V_{100}$) of the component (B) is preferably the upper limit value described below or less for suppressing the evaporation amount of the lubricating oil composition and achieving the oil film retaining capability, is preferably the lower limit value described below or more for achieving the fuel efficiency and the low temperature fluidity, and is preferably 2.000 $mm^2/s$ or more and 200.000 $mm^2/s$ or less, more preferably 2.500 $mm^2/s$ or more and 180.000 $mm^2/s$ or less, and further preferably 3.000 $mm^2/s$ or more and 150.000 $mm^2/s$ or less.

As described above, the addition of the component (B) improves the oil film forming capability, and thereby the wear resistance of the lubricating oil composition can be improved. However, the addition of the component (B) deteriorates the fuel efficiency and the low temperature fluidity. Accordingly, the content of the component (B) is necessarily allowed to be 0.01% by mass or more and 2.00% by mass or less based on the total amount of the lubricating oil composition, by combining the component (A) described above. The content of the component (B) is preferably the lower limit value described below or more for improving the oil film forming capability, is preferably the lower limit value described below or more for achieving the fuel efficiency and the low temperature fluidity, and is preferably 0.10% by mass or more and 1.80% by mass or less, more preferably 0.50% by mass or more and 1.50% by mass or less, further preferably 0.80% by mass or more and 1.30% by mass or less, and still further preferably 0.90% by mass or more and 1.10% by mass or less.

The component (B) may be a base oil having a kinematic viscosity at 40° C. of 100.000 $mm^2/s$ or more and 2000.000 $mm^2/s$ or less, which may be any of a mineral oil, a synthetic oil, and a mixed oil of a mineral oil and a synthetic oil, and is preferably a synthetic oil for achieving a kinematic viscosity at 40° C. of 100.000 $mm^2/s$ or more.

The mineral oil used may be the preferred mineral oil described for the component (A) that is a mineral oil having a kinematic viscosity at 40° C. of 100.000 $mm^2/s$ or more and 2000.000 $mm^2/s$ or less. The synthetic oil will be described later.

The pour point of the component (B) is preferably the upper limit value described below or less for achieving the low temperature fluidity, in which the lower limit value thereof is not particularly limited and is preferably the lower limit value described below or more for retaining the oil film forming capability with the component (B) described later, and is preferably −50° C. or more and −20° C. or less, more preferably −45° C. or more and −30° C. or less, and further preferably −45° C. or more and −38° C. or less.

The density at 15° C. of the component (B) used in the lubricating oil composition of the present embodiment is generally 0.800 $g/cm^3$ or more. The component (B) having a density at 15° C. of 0.950 $g/cm^3$ or less can provide a base oil having a lower temperature dependency of the viscosity and a higher flash point, and the density is preferably 0.800 $g/cm^3$ or more and 0.960 $g/cm^3$ or less, more preferably 0.820 $g/cm^3$ or more and 0.930 $g/cm^3$ or less, and further preferably 0.840 $g/cm^3$ or more and 0.920 $g/cm^3$ or less.

(Synthetic Oil)

The synthetic oil is not particularly limited, as far as having a kinematic viscosity at 40° C. of 100.000 $mm^2/s$ or more and 2000.000 $mm^2/s$ or less, and examples thereof include a poly-α-olefin, such as an α-olefin homopolymer and an α-olefin copolymer (for example, a copolymer of an α-olefin having 8 to 14 carbon atoms, such as an ethylene-α-olefin copolymer): isoparaffin; an ester based base oil, such as a polyol ester and a dibasic acid ester; an ether, such as a polyphenyl ether; a polyalkylene glycol; an alkylbenzene; an alkylnaphthalene; and a GTL base oil obtained through isomerization of wax produced from a natural gas by the Fischer-Tropsch process (gas-to-liquid (GTL) wax). One of the synthetic oils above may be used alone, or multiple kinds thereof may be used in combination.

The upper limit value of the kinematic viscosity at 40° C. ($V_{40}$) of the synthetic oil is preferably the upper limit value described below or less for achieving the fuel efficiency and the low temperature fluidity in combination with the component (A), and the kinematic viscosity at 40° C. thereof is preferably the lower limit value described below or more, and is preferably 150.000 $mm^2/s$ or more and 1800.000 $mm^2/s$ or less, more preferably 200.000 $mm^2/s$ or more and 1750.000 $mm^2/s$ or less, further preferably 200.000 $mm^2/s$ or more and 1700.000 $mm^2/s$ or less, still further preferably 250.000 $mm^2/s$ or more and 1650.000 $mm^2/s$ or less, and particularly preferably 250.000 $mm^2/s$ or more and 1620.000 $mm^2/s$ or less.

The kinematic viscosity at 100° C. ($V_{100}$) of the synthetic oil is preferably the lower limit value described below or more for suppressing the evaporation amount of the lubricating oil composition and achieving the oil film retaining capability, is preferably the upper limit value described below or less for achieving the fuel efficiency and the low temperature fluidity, and is preferably 2.000 $mm^2/s$ or more and 200.000 $mm^2/s$ or less, more preferably 2.500 $mm^2/s$ or more and 180.000 $mm^2/s$ or less, and further preferably 3.000 $mm^2/s$ or more and 150.000 $mm^2/s$ or less.

The mass average molecular weight (Mw) of the synthetic oil is preferably 5,000 or more and 100,000 or less for improving the wear resistance while retaining the low viscosity and the low traction coefficient of the lubricating oil composition in combination with the component (A), is preferably the lower limit value described below or more for achieving the low traction coefficient and the wear resistance, is preferably the upper limit value described below or less for retaining the oil film forming capability, retaining the low traction coefficient, and achieving the low temperature fluidity, and is preferably 10,000 or more and 80,000 or less, more preferably 11,000 or more and 70,000 or less, and further preferably 12,000 or more and 68,000 or less.

In the description herein, the mass average molecular weights (Mw) and the number average molecular weights (Mn) of the components are standard polystyrene conversion values measured by the gel permeation chromatography (GPC) method.

The content of the synthetic oil belonging to the component (B) is preferably the lower limit value described below or more for improving the oil film forming capability, is preferably the upper limit value described below or less for achieving the fuel efficiency and the low temperature fluidity, and is preferably 0.01% by mass or more and 2.00% by mass or less, more preferably 0.10% by mass or more and 1.80% by mass or less, further preferably 0.50% by mass or more and 1.50% by mass or less, still further preferably 0.80% by mass or more and 1.30% by mass or less, and particularly preferably 0.90% by mass or more and 1.10% by mass or less, based on the total amount of the lubricating oil composition.

The synthetic oil preferably contains at least one kind selected from a poly-α-olefin and an ester based base oil, in which a poly-α-olefin excellent in chemical stability is preferred for retaining the oil film forming capability up to a high temperature, and an ester based base oil excellent in adsorbability to a metal is preferred for retaining the oil film forming capability and achieving the high wear resistance.

(Poly-α-olefin)

Examples of the poly-α-olefin (which may be hereinafter referred to as "PAO") include a homopolymer or copolymer of a poly-α-olefin, an ethylene-α-olefin copolymer, and a poly butene. Among these, the homopolymer and the copolymer of a poly-α-olefin are preferably a homopolymer and a copolymer of a poly-α-olefin having 2 to 30 carbon atoms, more preferably 4 to 22 carbon atoms, further preferably 6 to 16 carbon atoms, still further preferably 6 to 14 carbon atoms, and particularly preferably 8 to 12, and the copolymer may be a random copolymer or a block copolymer.

Examples of the usable poly-α-olefin include poly-α-olefins having 2 to 30 carbon atoms, such as ethylene, propylene, isobutylene, 1-butene, 1-pentene, 1-hexene, 1-octene, 1-nonene, 1-decene, 1-dodecene, 1-undecene, 1-dodecene, 1-tridecene, 1-tetradecene, 1-pentadecane, 1-hexadecene, 1-heptadecene, 1-octadecene, 1-nonadecene, and 1-eicosene.

Further, examples of the ethylene-α-olefin copolymer include a copolymer of ethylene and an α-olefin, and the α-olefin used may be propylene or the same one as used in the homopolymer and the copolymer of an α-olefin described above. The ethylene-α-olefin copolymer may be a random copolymer.

One kind of the poly-α-olefin may be used alone, or two or more kinds thereof may be used in combination.

The poly-α-olefin can be produced by any method, and for example, can be produced through thermal reaction with no catalyst, or can be produced through homopolymerization or copolymerization of an olefin with the use of a known catalyst system, for example, an organic peroxide catalyst, such as benzoyl peroxide: a Friedel-Crafts type catalyst, such as aluminum chloride, an aluminum chloride-polyhydric alcohol system, an aluminum chloride-titanium tetrachloride system, an aluminum chloride-alkyl tin halide system, and boron fluoride: a Ziegler type catalyst, such as an organoaluminum chloride-titanium tetrachloride system and an organoaluminum-titanium tetrachloride system: a metallocene type catalyst, such as an aluminoxane-zirconocene system and an ionic compound-zirconocene system: and a Lewis acid complex type catalyst, such as an aluminum chloride-base system and boron fluoride-base system. Note that, in the present invention, the poly-α-olefin described above can be used, and in consideration of the thermal and acid stability thereof, a hydrogenated product of the poly-α-olefin obtained by hydrogenating the double bond in the poly-α-olefin can also be used.

The number of carbon atoms of the α-olefin as a raw material monomer of the poly-α-olefin i s preferably 8 or more and 12 or less, more preferably 9 or more and 11 or less, and further preferably 10, for improving the fuel efficiency and the wear resistance. Specifically, the α-olefins described above that have 8 or more 12 or less carbon atoms may be used.

The poly-α-olefin is produced preferably, for example, by the method described in WO 2012/035710.

Specifically, the high viscosity PAO can be obtained by one kind of the α-olefin alone or a mixture of two or more kinds thereof by using a polymerization catalyst containing a meso type transition metal compound (A), at least one compound (B) of a compound (B-1) capable of forming an ionic complex through reaction with the transition metal compound (A) or a derivative thereof and aluminoxane (B-2), and an organoaluminum compound (C).

The mass average molecular weight of the poly-α-olefin is preferably the lower limit value described below or more for achieving the low traction coefficient and the wear resistance in combination with the component (A), is preferably the upper limit value described below or less for retaining the oil film forming capability, achieving the low traction coefficient, and achieving the low temperature fluidity, and is preferably 5,000 or more and 100,000 or less, more preferably 10,000 or more and 80,000 or less, further preferably 30,000 or more and 70,000 or less, and still further preferably 40,000 or more and 70,000 or less.

The lower limit value of the kinematic viscosity at 40° C. ($V_{40}$) of the poly-α-olefin is preferably the lower limit value described below or more for retaining the oil film forming capability and achieving the high wear resistance, is preferably the upper limit value described below or less for achieving the fuel efficiency and the low temperature fluidity in combination with the component (A), and is preferably 150.000 $mm^2/s$ or more and 1800.000 $mm^2/s$ or less, more preferably 180.000 $mm^2/s$ or more and 1750.000 $mm^2/s$ or less, further preferably 200.000 $mm^2/s$ or more and 1700.000 $mm^2/s$ or less, and still further preferably 200.000 $mm^2/s$ or more and 1650.000 $mm^2/s$ or less.

The kinematic viscosity at 100° C. ($V_{100}$) of the poly-α-olefin is preferably the lower limit value described below or more for suppressing the evaporation amount of the lubricating oil composition and achieving the oil film retaining capability, is preferably the upper limit value described below or less for achieving the fuel efficiency and the low temperature fluidity, and is preferably 2.000 $mm^2/s$ or more and 200.000 $mm^2/s$ or less, more preferably 2.500 $mm^2/s$ or more and 180.000 $mm^2/s$ or less, and further preferably 3.000 $mm^2/s$ or more and 150.000 $mm^2/s$ or less.

(Ester Based Base Oil)

Examples of the ester based base oil include a diester based oil, such as dibutyl sebacate, di-2-ethylhexyl sebacate, dioctyl adipate, diisodecyl adipate, ditridecyl adipate, ditridecyl glutarate, and methylacetyl ricinolate; an aromatic ester based oil, such as trioctyl trimellitate, tridecyl trimellitate, tetraoctyl pyrromellitate; a polyol ester based oil, such as trimethylolpropane capry late, trimethylol propane pelargonate, pentaerythritol-2-ethylhexanoate, and pentaerythritol pelargonate; and a complex ester based oil, such as an oligoester of a polyhydric alcohol and a mixed fatty acid of a dibasic acid and a monobasic acid.

The ester based oil used is preferably a polyol ester. The polyol ester may be any of a partial ester of a polyol and a complete ester thereof, and a partial ester of a polyol is preferably used from the standpoint of the sludge solubility.

The polyol as the raw material of the polyol ester is not particularly limited, and is preferably an aliphatic polyol, and examples thereof include a dihy dric alcohol, such as ethylene glycol, diethylene glycol, triethylene glycol, propylene glycol, trimethylene glycol, tetramethylene glycol, and neopentyl glycol; a trihydric alcohol, such as glycerin, trimethylolethane, and trimethylolpropane; and a tetrahydric or higher hydric alcohol, such as diglycerin, triglycerin, pentaerythritol, dipentaerythritol, mannitol, and sorbitol.

The hydrocarbyl group constituting the polyol ester is preferably an alkyl or alkenyl group having 6 to 30 carbon atoms, and more preferably an alkyl or alkenyl group having 12 to 24 carbon atoms, and examples thereof include various hexyl groups, octyl groups, decyl groups, dodecyl groups, tetradecyl groups, hexadecyl groups, heptadecyl groups, octadecyl groups, hexenyl groups, octenyl groups, decenyl groups, dodecenyl groups, tetradecenyl groups, hexadecenyl groups, and octadecenyl groups.

The alkyl group and the alkenyl group may be linear or branched.

Specific examples of the complete ester of a polyol include neopentyl glycol dilaurate, neopentyl glycol dimyristate, neopentyl glycol dipalmitate, neopentyl glycol distearate, neopentyl glycol diisostearate, trimethylolpropane trilaurate, trimethylolpropane trimyristate, trimethylolpropane tripalmitate, trimethylolpropane tristearate, trimethylolpropane triisostearate, glycerin trilaurate, glycerin tristearate, and glycerin triisostearate, but are not limited thereto.

The partial ester of a polyol is not particularly limited, as far as having at least one hydroxy group remaining.

Specific examples of the partial ester of a polyol include neopentyl glycol monolaurate, neopentyl glycol monomyristate, neopentyl glycol monopalmitate, neopentyl glycol monostearate, neopentyl glycol monoisostearate, trimethylolpropane monolaurate or dilaurate, trimethylolpropane monomyristate or dimyristate, trimethylolpropane monopalmitate or dipalmitate, trimethylolpropane monostearate or distearate, trimethylolpropane monoisostearate or diisostearate, glycerin monolaurate or dilaurate, glycerin monostearate or distearate, and glycerin monoisostearate or diisostearate, and preferred examples thereof include trimethylolpropane monoisostearate or diisostearate, but are not limited thereto.

The mass average molecular weight (Mw) of the ester based base oil is preferably the lower limit value described below or more for achieving the low traction coefficient and the wear resistance in combination with the component (A), is preferably the upper limit value described below or less for retaining the oil film forming capability, achieving the low traction coefficient, and achieving the low temperature fluidity, and is preferably 5,000 or more and 60,000 or less, more preferably 10,000 or more and 50,000 or less, further preferably 15,000 or more and 45,000 or less, and still further preferably 20,000 or more and 40,000 or less.

The kinematic viscosity at 40° C. ($V_{40}$) of the ester based base oil is preferably the lower limit value described below or more for retaining the oil film forming capability and achieving the high wear resistance in combination with the component (A), is preferably the upper limit value described below or less for achieving the fuel efficiency and the low temperature fluidity, and is preferably 150.000 $mm^2/s$ or more and 1800.000 $mm^2/s$ or less, more preferably 180.000 $mm^2/s$ or more and 1750.000 $mm^2/s$ or less, further preferably 190.000 $mm^2/s$ or more and 1700.000 $mm^2/s$ or less, and particularly preferably 200.000 $mm^2/s$ or more and 1650.000 $mm^2/s$ or less.

The ester based base oil is different from the friction modifier described later in kinematic viscosity at 40° C. The ester based base oil preferably has a kinematic viscosity at 40° C. within the aforementioned range for achieving the low traction coefficient and the low temperature fluidity, but the friction modifier has a higher value thereof as described later.

The kinematic viscosity at 100° C. ($V_{100}$) of the ester based base oil is preferably the lower limit value described below or more for suppressing the evaporation amount of the lubricating oil composition and achieving the oil film retaining capability, is preferably the upper limit value described below or less for achieving the fuel efficiency and the low temperature fluidity, and is preferably 2.000 $mm^2/s$ or more and 200.000 $mm^2/s$ or less, more preferably 2.500 $mm^2/s$ or more and 180.000 $mm^2/s$ or less, and further preferably 3.000 $mm^2/s$ or more and 150.000 $mm^2/s$ or less.

Components (A) and (B): Base Oil

The lubricating oil composition of the present embodiment contains the base oil, i.e., the component (A) and the component (B), and the case where the total content of the component (A) and the component (B) is 70.00% by mass or more based on the total amount of the lubricating oil composition is preferred since the low viscosity, the fuel efficiency, the wear resistance, the usability with a high flash point, and the low temperature fluidity can be achieved. The total content of the component (A) and the component (B) is preferably the lower limit value described below or more for improving the low viscosity, the fuel efficiency, the wear resistance, the usability with a high flash point, and the low temperature fluidity, in which the upper limit value thereof is not particularly limited, and substantially only the component (A) and the component (B) may be contained, is preferably the upper limit value described below or less in the case where the lubricating oil composition contains the component (C), the component (D) and the additional component described later, and is preferably 70.00% by mass or more and 100.00% by mass or less, more preferably 80.00% by mass or more and 99.80% by mass or less, further preferably 85.00% by mass or more and 95.00% by mass or less, still further preferably 90.00% by mass or more and 93.00% by mass or less, and particularly preferably 91.00% by mass or more and 92.00% by mass or less.

The upper limit value of the kinematic viscosity at 40° C. ($V_{40}$) of only the component (A) and the component (B) in the lubricating oil composition of the present embodiment is preferably the upper limit value described below or less for achieving the fuel efficiency with a low viscosity and a low traction coefficient, and the low temperature fluidity with a low BF viscosity at −40° C., is preferably the lower limit value described below or more for retaining the oil film forming capability and achieving the high wear resistance, and is preferably 2.000 $mm^2/s$ or more and 85.000 $mm^2/s$ or less, more preferably 4.000 $mm^2/s$ or more and 60.000 $mm^2/s$ or less, and further preferably 7.000 $mm^2/s$ or more and 30.000 $mm^2/s$ or less.

The kinematic viscosity at 100° C. ($V_{100}$) of only the component (A) and the component (B) in the lubricating oil composition of the present embodiment is preferably 1.000 $mm^2/s$ or more and 10.000 $mm^2/s$ or less, more preferably 1.500 $mm^2/s$ or more and 8.000 $mm^2/s$ or less, and further preferably 2.000 $mm^2/s$ or more and 5.000 $mm^2/s$ or less.

These preferred ranges are the same as in the case where a mineral oil is used as the component (A), and a synthetic oil is used as the component (B).

The viscosity index of only the component (A) and the component (B) used in the present embodiment is preferably 80 or more, more preferably 90 or more, and further preferably 120 or more, for suppressing the viscosity change depending on the temperature, and achieving the lubricating oil composition having an enhanced fuel efficiency. The upper limit value thereof is not particularly limited. These preferred ranges are the same as in the case where a mineral oil is used as the component (A), and a synthetic oil is used as the component (B).

The component (A) and the component (B) each may be any of a mineral oil, a synthetic oil, and a mixed oil of a mineral oil and a synthetic oil, as described above, and the case where the component (A) is a mineral oil, and the component (B) is a synthetic oil is preferred since the low viscosity, the fuel efficiency, the wear resistance, the usability with a high flash point, and the low temperature fluidity can be achieved.

It is preferred that the total content of the mineral oil as the component (A) and the synthetic oil as the component (B) is 70.00% by mass or more based on the total amount of the lubricating oil composition, and the lubricating oil composition is constituted by substantially only the mineral oil as the component (A) and the synthetic oil as the component (B), and the total content thereof is more preferably 80.00% by mass or more and 99.80% by mass or less, further preferably 85.00% by mass or more and 95.00% by mass or less, still further preferably 90.00% by mass or more and 93.00% by mass or less, and particularly preferably 91.00% by mass or more and 92.00% by mass or less.

Component (C): Anti-Wear Agent

The lubricating oil composition of the present embodiment may further contain an anti-wear agent as a component (C). The use of the component (C) contained is preferred since the wear resistance can be further improved.

The component (C) is preferably a phosphorus based anti-wear agent, a metal salt of a carboxylic acid, and a sulfur based anti-wear agent.

Examples of the phosphorus based anti-wear agent include a neutral phosphate ester, an acidic phosphate ester, a phosphite ester, an acidic phosphite ester, and amine salts thereof, and at least one kind selected from an acidic phosphate ester and a neutral phosphate ester is preferred.

In the case where at least one kind selected from an acidic phosphate ester and a neutral phosphate ester is contained as the component (C), the content of the component (C) in terms of phosphorus atom is preferably 10.0 ppm by mass or more and 1000.0 ppm by mass or less, more preferably 100.0 ppm by mass or more and 700.0 ppm by mass or less, further preferably 200.0 ppm by mass or more and 400.0 ppm by mass or less, and still further preferably 280.0 ppm by mass or more and 320.0 ppm by mass or less, based on the total amount of the lubricating oil composition, for improving the wear resistance.

In the case where the lubricating oil composition of the present embodiment contains at least one kind selected from an acidic phosphate ester and a neutral phosphate ester as the component (C), the content thereof in terms of phosphorus atom is preferably regulated to make the content thereof in terms of phosphorus atom within the aforementioned range, and specifically the content of the component (C) is preferably 0.001% by mass or more and 5.00% by mass or less, more preferably 0.01% by mass or more and 4.00% by mass or less, further preferably 0.10% by mass or more and 2.00% by mass or less, and still further preferably 0.50% by mass or more and 1.00% by mass or less, based on the total amount (100% by mass) of the lubricating oil composition, for further improving the wear resistance.

The component (C) is preferably at least one kind or more kinds selected from a neutral phosphate ester and an acidic phosphate ester, and more preferably two or more kinds thereof contained in combination, for enhancing the extreme pressure capability and the wear characteristics. In the case where two or more kinds thereof are contained in combination, at least one kind selected from each of a neutral phosphate ester and an acidic phosphate ester are preferably contained.

The neutral phosphate ester is preferably a compound represented by the following general formula (C-1).

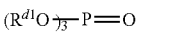

(C-1)

In the general formula (C-1), $R^{d1}$ represents a hydrocarbon group having 1 to 30 carbon atoms. Preferred examples of the hydrocarbon group include an alkyl group, an alkenyl group, an aryl group, and arylalkyl group, from the standpoint of achieving the further excellent wear resistance, in which an aryl group or an arylalkyl group is preferred, and an arylalkyl group is more preferred.

In the general formula (C-1), the three groups represented by $R^{d1}$ may be the same as or different from each other, and are preferably the same as each other in view of the availability.

In the case of an alkyl group, the number of carbon atoms thereof is preferably 2 to 20, and more preferably 2 to 10, from the standpoint of achieving the further excellent wear resistance and in consideration of the availability and the like. The alkyl group may be any of linear, branched, and cyclic, and a liner or branched alkyl group is preferred in consideration of the availability and the like.

In the case of an alkenyl group, the number of carbon atoms thereof is preferably 2 to 20, and more preferably 2 to 10, from the standpoint of achieving the further excellent wear resistance and in consideration of the availability and the like. The alkenyl group may be any of linear, branched, and cyclic, and a liner or branched alkenyl group is preferred.

In the case of an aryl group, the number of carbon atoms thereof is preferably 6 to 20, more preferably 6 to 15, and further preferably 6 to 10, from the standpoint of achieving the further excellent seizing resistance and wear resistance and in consideration of the availability and the like.

In the case of an arylalkyl group, the number of carbon atoms thereof is preferably 6 to 20, more preferably 6 to 15, and further preferably 6 to 8, from the standpoint of achieving the further excellent seizing resistance and wear resistance and in consideration of the availability and the like.

Preferred examples of the neutral phosphate ester include triphenyl phosphate, tricresyl phosphate, benzyl diphenyl phosphate, ethyl diphenyl phosphate, tributyl phosphate, ethyl dibutyl phosphate, tert-butylphenyl diphenyl phosphate, di-tert-butylphenyl monophenyl phosphate, cresyl diphenyl phosphate, dicresyl monophenyl phosphate, ethylphenyl diphenyl phosphate, diethylphenyl monophenyl phosphate, triethylphenyl phosphate, trihexyl phosphate, tri (2-ethylhexyl) phosphate, tridecyl phosphate, trilauryl phosphate, trimyristyl phosphate, tripalmityl phosphate, tristearyl phosphate, and trioleyl phosphate, and tricresyl phosphate is particularly preferred.

In the case where the neutral phosphate ester is contained, the content of the neutral phosphate ester in terms of phosphorus atom is preferably 10.0 ppm by mass or more and 500.0 ppm by mass or less, more preferably 100.0 ppm by mass or more and 350.0 ppm by mass or less, further preferably 200.0 ppm by mass or more and 200.0 ppm by mass or less, and still further preferably 140.0 ppm by mass or more and 160.0 ppm by mass or less, based on the total amount of the lubricating oil composition, for improving the wear resistance.

In the lubricating oil composition of the present embodiment, the content of the neutral phosphate ester is preferably regulated to make the content thereof in terms of phosphorus atom within the aforementioned range, and specifically the content thereof is preferably 0.001% by mass or more and 3.00% by mass or less, more preferably 0.01% by mass or more and 2.00% by mass or less, further preferably 0.10% by mass or more and 1.00% by mass or less, and still further preferably 0.30% by mass or more and 0.50% by mass or less, based on the total amount (100% by mass) of the lubricating oil composition, for further improving the wear resistance.

The acidic phosphate ester is preferably a compound represented by the following general formula (C-2).

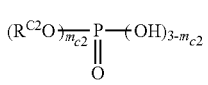

(C-2)

In the general formula (C-2), $R^{C2}$ represents a hydrocarbon group having 1 to 30 carbon atoms. Preferred examples of the hydrocarbon group include an alkyl group, an alkenyl group, an aryl group, and arylalkyl group, from the standpoint of achieving the further excellent wear resistance, in which an alkyl group or an alkenyl group is preferred, and an alkyl group is more preferred.

In the general formula (C-2), in the case where $m_{C2}$ represents 2, and multiple groups represented by $R^{C2}$ exists, the groups may be the same as or different from each other, and are preferably the same as each other in view of the availability.

In the case of an alkyl group, the number of carbon atoms thereof is preferably 2 to 20, and more preferably 6 to 10, from the standpoint of achieving the further excellent wear resistance and in consideration of the availability and the like. The alkenyl group may be any of linear, branched, and cyclic, and a liner or branched alkenyl group is preferred in consideration of the availability and the like.

In the case of an alkenyl group, the number of carbon atoms thereof is preferably 2 to 20, and more preferably 2 to 10, from the standpoint of achieving the further excellent wear resistance and in consideration of the availability and the like. The alkenyl group may be any of linear, branched, and cyclic, and a liner or branched alkenyl group is preferred.

In the case of an aryl group, the number of carbon atoms thereof is preferably 6 to 20, and more preferably 6 to 15, from the standpoint of achieving the further excellent seizing resistance and wear resistance and in consideration of the availability and the like.

In the case of an arylalkyl group, the number of carbon atoms thereof is preferably 6 to 20, and more preferably 6 to 15, from the standpoint of achieving the further excellent seizing resistance and wear resistance and in consideration of the availability and the like.

Additionally, in the general formula (C-2), $m_{C2}$ represents 1 or 2, and a compound where $m_{C2}$ is 1 and a compound where $m_{C2}$ is 2, in which the groups of $R^{C2}$ have the same meaning, are also preferably contained.

Preferred examples of the acidic phosphate ester include mono(di)ethyl acid phosphate, mono(di)-n-propyl acid phosphate, mono(di)2-ethylhexyl acid phosphate, mono(di) butyl acid phosphate, mono(di)oleyl acid phosphate, mono (di)isodecyl acid phosphate, mono(di)lauryl acid phosphate, mono(di)stearyl acid phosphate, and mono(di)isostearyl acid phosphate.

Examples of the metal salt of a carboxylic acid include a metal salt of a carboxylic acid having 3 to 60 (preferably 3 to 30) carbon atoms.

In particular, one or more kind selected from metal salts of a fatty acid having 12 to 30 carbon atoms and a dicarboxylic acid having 3 to 30 carbon atoms is preferred.

Further, the metal constituting the metal salt is preferably an alkali metal and an alkaline earth metal, and more preferably an alkali metal.

In the case where the acidic phosphate ester is contained, the content of the acidic phosphate ester in terms of phosphorus atom is preferably 10.0 ppm by mass or more and 500.0 ppm by mass or less, more preferably 100.0 ppm by mass or more and 350.0 ppm by mass or less, further preferably 120.0 ppm by mass or more and 200.0 ppm by mass or less, and still further preferably 140.0 ppm by mass or more and 160.0 ppm by mass or less, based on the total amount of the lubricating oil composition, for improving the wear resistance.

In the lubricating oil composition of the present embodiment, the content of the acidic phosphate ester is preferably regulated to make the content thereof in terms of phosphorus atom within the aforementioned range, and specifically the content thereof is preferably 0.001% by mass or more and 3.00% by mass or less, more preferably 0.01% by mass or more and 2.00% by mass or less, further preferably 0.10% by mass or more and 1.00% by mass or less, and still further preferably 0.30% by mass or more and 0.50% by mass or less, based on the total amount (100% by mass) of the lubricating oil composition, for further improving the wear resistance.

The sulfur based anti-wear agent contained may also be, in addition to the neutral phosphate ester and the acidic phosphate ester, for example, a sulfurated fat or oil, a sulfurated fatty acid, a sulfurated ester, a sulfurated olefin, a dihydrocarbyl polysulfide, a thiocarbamate compound, a thioterpene compound, and a dialkyl thiodipropionate compound.

The content of the anti-wear agent is preferably 0.001% by mass or more and 5.00% by mass or less, more preferably 0.005% by mass or more and 4.00% by mass or less, and further preferably 0.01% by mass or more and 3.00% by mass or less, based on the total amount (100% by mass) of the lubricating oil composition, from the standpoint of the wear resistance.

Component (D): Friction Modifier

The lubricating oil composition of the present embodiment may further contain a friction modifier as a component (D). The friction modifier is preferably an ash-free friction modifier. The addition of a friction modifier is preferred since the fuel efficiency can be further enhanced.

The content of the friction modifier is preferably 0.001% by mass or more and 3.00% by mass or less, more preferably 0.01% by mass or more and 1.00% by mass or less, further preferably 0.10% by mass or more and 0.80% by mass or less, and still further preferably 0.20% by mass or more and 0.50% by mass or less, based on the total amount (100% by mass) of the lubricating oil composition, from the standpoint of the wear resistance.

The ash-free friction modifier contained in the lubricating oil composition of the present invention is preferably an ash-free compound that has a function as a friction modifier, and has a polar group containing one or more atom selected from an oxygen atom, a nitrogen atom, a sulfur atom, and a phosphorus atom, and an oleophilic group. Examples of the ash-free compound include an amine based friction modifier, an ester based friction modifier, an amide based friction modifier, a fatty acid based friction modifier, an alcohol based friction modifier, an ether based friction modifier, a urea based friction modifier, and a hydrazide based friction modifier, in which at least one kind selected from an ester based friction modifier and an amide based friction modifier is preferably contained, and it is preferred to use an ester based friction modifier and an amide based friction modifier in combination.

Note that, in the lubricating oil composition of one embodiment of the present invention, the ash-free friction modifier may be used alone, or two or more kinds thereof may be used in combination.

In the lubricating oil composition of the present embodiment, the content of the ash-free friction modifier is preferably 0.01% by mass or more and 3.00% by mass or less, more preferably 0.05% by mass or more and 1.00% by mass or less, further preferably 0.10% by mass or more and 0.80% by mass or less, and still further preferably 0.20% by mass or more and 0.50% by mass or less, based on the total amount (100% by mass) of the lubricating oil composition.

The ash-free friction modifier preferably satisfies the following requirements.

(1) The ash-free friction modifier is a compound having an alkyl group having 10 to 30 carbon atoms or an alkenyl group having 10 to 30 carbon atoms, and more preferably a compound having an unsubstituted linear alkyl group having 10 to 30 carbon atoms or an unsubstituted linear alkenyl group having 10 to 30 carbon atoms.

(2) The ash-free friction modifier is a compound having one or more hydroxy group.

(3) The compound described in the item (1) or (2) above is a compound selected from a fatty acid ester, a fatty acid amine, a fatty acid amide, and a fatty acid ether, more preferably is a fatty acid ester or a fatty acid amine, and further preferably contains both a fatty acid ester and a fatty acid amine.

It is considered that a compound or an embodiment that satisfies the items (1) to (3) above adsorbs on a solid surface via the hydroxy group as a polar group, and the unsubstituted alkyl group or the unsubstituted alkenyl group as an oleophilic group is oriented in the direction perpendicular to the solid surface, thereby allowing the base oil to flow.

Particularly preferred ester based friction modifiers and amide based friction modifiers will be described in detail below.

(Ester Based Friction Modifier)

Examples of the fatty acid ester that is preferred as an ash-free friction modifier include a partial ester compound having one or more hydroxy group, such as a partial ester compound obtained through reaction of a fatty acid and an aliphatic polyhydric alcohol (which may be hereinafter referred to as a fatty acid polyhydric alcohol ester).

The number of carbon atoms of the alkyl group and the alkenyl group of the fatty acid is 10 to 30, preferably 12 to 24, and more preferably 14 to 20.

Specific examples of the fatty acid include a saturated fatty acid, such as caproic acid, caprylic acid, capric acid, lauric acid, myristic acid, palmitic acid, stearic acid, arachinic acid, behenic acid, and lignoceric acid; and an unsubstituted fatty acid, such as myristoleic acid, palmitoleic acid, oleic acid, and linolenic acid.

Further, the aliphatic polyhydric alcohol constituting the fatty acid ester is preferably a dihydric to hexahydric alcohol, and specific examples thereof include ethylene glycol, glycerin, trimethylolpropane, pentaerythritol, and sorbitol.

Among these, the aliphatic polyhydric alcohol is preferably glycerin.

Examples of the fatty acid partial ester compound having one or more hydroxy group obtained through reaction of glycerin and the fatty acid (which may be hereinafter referred to as a glycerin ester compound) include a monoester, such as glycerin monomyristate, glycerin monopalmitate, and glycerin monooleate, and a diester, such as glycerin dimyristate, glycerin dipalmitate, and glycerin dioleate.

Among these, the glycerin ester compound is preferably a monoester compound, and more preferably a compound represented by the following general formula (D-1).

(D-1)

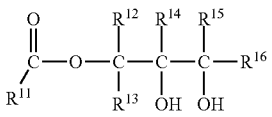

In the general formula (D-1), $R^{11}$ represents an alkyl group having 10 to 30 carbon atoms or an alkenyl group having 10 to 30 carbon atoms.

The numbers of carbon atoms of the alkyl group and the alkenyl group that can be selected as $R^{11}$ each independently are 10 to 30, preferably 12 to 24, more preferably 14 to 20, further preferably 16 to 20, and still further preferably 18.

In addition, in the general formula (D-1), $R^{12}$ to $R^{16}$ each independently represent a hydrogen atom or a hydrocarbon group having 1 to 18 carbon atoms.

The numbers of carbon atoms of the alkyl groups and the alkenyl groups that can be selected as $R^{12}$ to $R^{16}$ each independently are 1 to 18, preferably 1 to 12, more preferably 1 to 8, further preferably 1 to 6, and still further preferably 1 to 3.

Examples of the hydrocarbon group that can be selected as $R^{12}$ to $R^{16}$ include an alkyl group, an alkenyl group, a cycloalkyl group, a cycloalkenyl group, an aryl group, an alkylaryl group.

Among these, $R^{12}$ to $R^{16}$ each are preferably a hydrogen atom, an alkyl group, or an alkenyl group, and more preferably a hydrogen atom or an alkyl group, and it is further preferred that all of them are hydrogen atoms. The numbers of carbon atoms thereof are as described above.

In the lubricating oil composition of the present embodiment, the content of the ester based friction modifier is preferably 0.01% by mass or more and 2.00% by mass or less, more preferably 0.05% by mass or more and 1.00% by mass or less, further preferably 0.10% by mass or more and 0.50% by mass or less, and still further preferably 0.15% by mass or more and 0.30% by mass or less, based on the total amount (100% by mass) of the lubricating oil composition.

(Amide Based Friction Modifier)

The fatty acid amide that is preferred as the ash-free friction modifier is preferably a compound represented by the following general formula (D-3).

(D-3)

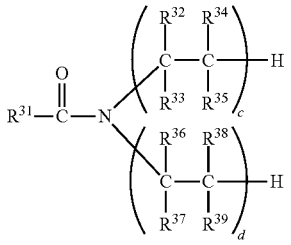

In the general formula (D-3), $R^{31}$ represents an alkyl group having 10 to 30 carbon atoms or an alkenyl group having 10 to 30 carbon atoms.

The numbers of carbon atoms of the alkyl group and the alkenyl group that can be selected as $R^{31}$ each independently are 10 to 30, preferably 12 to 24, and more preferably 14 to 20.

In the general formula (D-3), $R^{32}$ to $R^{39}$ each independently represent a hydrogen atom, a hydrocarbon group having 1 to 18 carbon atoms, or an oxygen-containing hydrocarbon group having an ether bond or an ester bond.

c and d each independently represent an integer of 1 to 20, preferably an integer of 1 to 10, more preferably an integer of 1 to 5, further preferably 1 or 2, and still further preferably 1.

Note that, in the case where c is 2 or more, for example, multiple groups represented by $R^{32}$ exist, and the multiple groups represented by $R^{32}$ may be the same as or different from each other. The same is applied to the cases where multiple groups represented by $R^{33}$ to $R^{39}$ except for $R^{32}$ exist.

Furthermore, the total of c and d is preferably 2 to 20, more preferably 2 to 10, further preferably 2 to 4, and still further preferably 2.

The numbers of carbon atoms of the hydrocarbon groups that can be selected as $R^{32}$ to $R^{39}$ each independently are 1 to 18, preferably I to 12, more preferably I to 8, further preferably 1 to 6, and still further preferably 1 to 3.

Examples of the hydrocarbon group that can be selected as $R^{32}$ to $R^{39}$ include an alkyl group, an alkenyl group, a cycloalkyl group, a cycloalkenyl group, an aryl group, an alkylaryl group.

The numbers of carbon atoms of the oxygen-containing hydrocarbon groups that can be selected as $R^{32}$ to $R^{39}$ each independently are 1 to 18, preferably 1 to 12, more preferably 1 to 8, further preferably 1 to 6, and still further preferably 1 to 3.

Examples of the oxygen-containing hydrocarbon group that can be selected as $R^{32}$ to $R^{39}$ include a methoxymethyl group, an ethoxymethyl group, a propoxymethyl group, an isopropoxymethyl group, a n-butoxymethyl group, a t-butoxy methyl group, a hexyloxymethyl group, an octyloxymethyl group, a 2-ethylhexyloxymethyl group, a decyloxymethyl group, a dodecyloxymethyl group, a 2-butyloctyloxymethyl group, a tetradecyloxymethyl group, a hexadecyloxymethyl group, a 2-hexyldodecyloxymethyl group, an allyloxymethyl group, a phenoxy group, a benzyloxy group, a methoxyethyl group, a methoxypropyl group, a 1,1-bismethoxypropyl group, a 1,2-bismethoxypropyl group, an ethoxypropyl group, a (2-methoxyethoxy) propyl group, a (1-methyl-2-methoxy)propyl group, an acetyloxymethyl group, a propanoyloxymethyl group, a butanoyloxymethyl group, a hexanoyloxymethyl group, an octanoy loxymethyl group, a 2-ethy lhexanoyloxymethyl group, a decanoyloxymethyl group, a dodecanoyloxymethyl group, a 2-butyloctanoyloxymethyl group, a tetradecanoyloxymethyl group, a hexadecanoyloxymethyl group, a 2-hexyldodecanoyloxymethyl group, and a benzoyloxymethyl group.

Among these, $R^{32}$ to $R^{39}$ each preferably represent a hydrogen atom or a hydrocarbon group, more preferably a hydrogen atom, an alkyl group, or an alkenyl group, and further preferably a hydrogen atom or an alkyl group, and it is still further preferred that all of them are hydrogen atoms.

In the lubricating oil composition of the present embodiment, the content of the amide based friction modifier is preferably 0.01% by mass or more and 2.00% by mass or less, more preferably 0.03% by mass or more and 1.00% by mass or less, further preferably 0.05% by mass or more and 0.50% by mass or less, and still further preferably 0.08% by mass or more and 0.20% by mass or less, based on the total amount (100% by mass) of the lubricating oil composition.

In the case where the ester based friction modifier and the amide based friction modifier are used in combination, the value of the ratio of the content of the amide based friction modifier with respect to the content of the ester based friction modifier (content of amide based friction modifier/content of ester based friction modifier) is preferably 0.10 or more and 0.80 or less, preferably 0.20 or more and 0.70 or less, preferably 0.30 or more and 0.65 or less, and preferably 0.40 or more and 0.60 or less, for improving the wear resistance and the low temperature fluidity.

Additional Additive

The lubricating oil composition of the present embodiment may further contain, as an additional additive, at least one kind selected from an antioxidant, a detergent, a dispersant, a pour point depressant, and an anti-foaming agent that are capable of enhancing the product quality.

(Antioxidant)

The antioxidant is preferably one or more kind selected from a phenol based antioxidant and an amine based antioxidant.

Examples of the phenol based antioxidant include 2,6-di-tert-butyl-4-methylphenol (DBPC), 2,6-di-tert-butyl-4-ethylphenol, and 2,2'-methylenebis (4-methyl-6-tert-butylphenol).

Examples of the amine based antioxidant include phenyl-α-naphthylamine and N,N'-diphenyl-p-phenylenediamine.

Among these, 2,6-di-tert-butyl-4-methylphenol (DBPC) is more preferred.

The content of the antioxidant is preferably 0.01% by mass or more and 5.00% by mass or less, and more preferably 0.05% by mass or more and 3.00% by mass or less, based on the total amount (100% by mass) of the lubricating oil composition, from the standpoint of the stability and the antioxidation capability.

(Detergent)

Examples of the detergent include a metal based detergent, such as a salicylate, a sulfonate, and a phenate of sodium, calcium, and magnesium.

One kind of these materials may be used alone, or two or more kinds thereof may be used in combination.

(Dispersant)

Examples of the dispersant include an ash-free dispersant, such as a non-boron-containing succinimide compound, a boron-containing succinimide compound, a benzylamine compound, a boron-containing benzylamine compound, a succinate ester compound, and a monobasic or dibasic carboxylic acid represented by a fatty acid and succinic acid.

One kind of these materials may be used alone, or two or more kinds thereof may be used in combination.

(Pour Point Depressant)

Examples of the pour point depressant include a polymer, such as an ethylene-vinyl acetate copolymer, a condensate of chlorinated paraffin and naphthalene, a condensate of chlorinated paraffin and phenol, a polymethacrylate, and a polyalkylstyrene. The mass average molecular weight (Mw) of the polymer is preferably 50,000 to 150,000.

(Anti-Foaming Agent)

Examples of the anti-foaming agent include a silicone based anti-foaming agent, a fluorine based anti-foaming agent, such as a fluorosilicone oil and a fluoroalkyl ether, and a polyacrylate based anti-foaming agent.

In the case where the lubricating oil composition of the present embodiment contains an anti-foaming agent, the content of the anti-foaming agent in terms of resin content is preferably 0.0001% by mass or more and 0.20% by mass or less, and more preferably 0.0005% by mass or more and 0.10% by mass or less, based on the total amount of the lubricating oil composition.

Content Ratios of Components

In the following description, the content of the component (A) based on the total amount of the lubricating oil composition is represented by $C_A$ (% by mass), the content of the component (B) based on the total amount of the lubricating oil composition is represented by $C_B$ (% by mass), the content of the component (C) based on the total amount of the lubricating oil composition is represented by $C_C$ (% by mass), and the content of the component (D) based on the total amount of the lubricating oil composition is represented by $C_D$ (% by mass). The preferred ranges are the same as in the case where a mineral oil is used as the component (A), and a synthetic oil is used as the component (B).

$C_B+C_D$ is preferably 0.01% by mass or more and 5.00% by mass or less, the range of which is preferred since the high oil film forming capability is obtained, and the wear resistance is enhanced. In this point, $C_B+C_D$ is preferably 0.01% by mass or more and 5.00% by mass or less, more preferably 0.10% by mass or more and 4.00% by mass or less, further preferably 0.30% by mass or more and 3.00% by mass or less, and still further preferably 0.50% by mass or more and 1.50% by mass or less.

$C_A+C_B+C_C+C_D$ is preferably 70.00% by mass or more, more preferably 80.00% by mass or more, further preferably 90.00% by mass or more, still further preferably 95.00% by mass or more, and particularly preferably 98.00% by mass or more, and it is possible that substantially only the component (A), the component (B), the component (C), and the component (D) are contained, for achieving the effects of the present invention. The term "substantially" herein means that a component that is unintentionally contained is excluded. The upper limit value thereof is not particularly limited, and is more preferably 99.00% by mass or less, and it is most preferred that substantially only the component (A), the component (B), the component (C), and the component (D) are contained.

The value of the ratio of $C_B$ and $C_D$ ($C_B/C_D$) is preferably 0.50 or more and 20.00 or less.

While both the component (B) and the component (D) are components having the oil film forming capability, the component (D) is adsorbed on the solid surface, and the unsubstituted alkyl group or the unsubstituted alkenyl group as an oleophilic group is oriented in the direction perpendicular to the solid surface, thereby allowing the component (B) to flow. Therefore, $C_B/C_D$ within the aforementioned range is preferred since the oil film forming capability of the component (B) can be further exhibited through the synergistic effect with the component (D). In this point, $C_B/C_D$ is preferably 0.50 or more and 20.00 or less, more preferably 1.00 or more and 15.00 or less, further preferably 2.00 or more and 7.00 or less, still further preferably 2.50 or more and 4.00 or less, and particularly preferably 3.00 or more and 3.50 or less.

While both the component (A) and the component (B) are base oils, the value of the ratio of $C_B$ and $C_A$ ($C_A/C_B$) is preferably 80.00 or more and 99.00 or less since the fuel efficiency, the wear resistance, the usability with a high flash point, and the low temperature fluidity can be improved. In this point, $C_A/C_B$ is preferably 80.00 or more and 99.00 or less, more preferably 85.00 or more to 98.00 or less, further preferably 86.00 or more and 95.00 or less, still further preferably 88.00 or more and 94.00 or less, and particularly preferably 90.00 or more and 92.00 or less.

The value of the ratio of $C_D$ and $C_A$ ($C_A/C_D$) is preferably 90.00 or more and 900.00 or less since the usability with a high flash point and the low temperature fluidity can be improved while improving the fuel efficiency and the wear resistance. In this point, $C_A/C_D$ is preferably 90.00 or more and 900.00 or less, more preferably 150.00 or more and 700.00 or less, further preferably 200.00 or more and 500.00 or less, still further preferably 250.00 or more and 400.00 or less, and particularly preferably 280.00 or more and 350.00 or less.

The value of the ratio of the total of $C_A$ and $C_B$, and the $C_D$ ($C_D/(C_A+C_B)$) is preferably 0.0001 or more and 0.0500 or less since the usability and the low temperature fluidity can be improved while improving the fuel efficiency and the wear resistance. In this point, $C_D/(C_A+C_B)$ is preferably 0.0001 or more and 0.0500 or less, more preferably 0.0005 or more and 0.0100 or less, further preferably 0.0010 or more and 0.0080 or less, and still further preferably 0.0020 or more and 0.0050 or less.

The value of the ratio of $C_A$, and the total of $C_B$ and $C_D$ ($(C_B+C_D)/C_A$) is preferably 0.0001 or more and 0.1000 or less since a high oil film forming capability can be achieved, and the wear resistance can be enhanced. In this point, the value of the ratio is more preferably 0.0010 or more and 0.0800 or less, further preferably 0.0050 or more and 0.0500 or less, still further preferably 0.0080 or more and 0.0300 or less, and particularly preferably 0.0100 or more and 0.0200 or less.

The content of the total phosphorus atoms contained in the lubricating oil composition is preferably 10.0 ppm by mass or more and 1000.0 ppm by mass or less based on the total amount of the lubricating oil composition for enhancing the wear resistance. In this point, the content thereof is more preferably 100.0 ppm by mass or more and 700.0 ppm by mass or less, further preferably 200.0 ppm by mass or more and 400.0 ppm by mass or less, and still further preferably 250.0 ppm by mass or more and 350.0 ppm by mass or less.

The content of the total sulfur atoms contained in the lubricating oil composition has the upper limit value for achieving the low viscosity and the low traction coefficient, and the lower limit value is not particularly limited, for enhancing the wear resistance, is preferably 1500.0 ppm by mass or less, more preferably 100.0 ppm by mass or more and 1300.0 ppm by mass or less, further preferably 500.0 ppm by mass or more and 1000.0 ppm by mass or less, and still further preferably 600.0 ppm by mass or more and 800.0 ppm by mass or less, based on the total amount of the lubricating oil composition.

The total content of the component (A), the component (B), the component (C), the component (D), and the additional additive is preferably 98.00% by mass or more, more preferably 98.50% by mass or more, further preferably 99.00% by mass or more, and still further preferably 99.50% by mass or more, the upper limit value of which is not particularly limited, and is preferably substantially 100% by mass, based on the total amount of the lubricating oil composition, for satisfying the fuel efficiency with a low viscosity and a low traction coefficient, the wear resistance, the usability with a high flash point, and the low temperature fluidity, at high levels.

Property Values of Lubricating Oil Composition (Kinematic Viscosity at 40° C.>

The kinematic viscosity at 40° C. of the lubricating oil composition of the present embodiment is preferably the lower limit value described below or more for retaining the oil film forming capability, achieving the high wear resistance, and achieving the low traction coefficient, is preferably the upper limit value described below or less for achieving the fuel efficiency and the low temperature fluidity, and is preferably 3.000 $mm^2/s$ or more and 100.000 $mm^2/s$ or less, more preferably 5.000 $mm^2/s$ or more and 50.000 $mm^2/s$ or less, further preferably 8.000 $mm^2/s$ or more and 20.000 $mm^2/s$ or less, still further preferably 10.000 $mm^2/s$ or more and 15.000 $mm^2/s$ or less, and particularly preferably 11.000 $mm^2/s$ or more and 13.000 $mm^2/s$ or less.

(Kinematic Viscosity at 100° C.>

The kinematic viscosity at 100° C. of the lubricating oil composition of the present embodiment is preferably the lower limit value described below or more for retaining the oil film forming capability, achieving the high wear resistance, and achieving the low traction coefficient, is preferably the upper limit value described below or less for achieving the fuel efficiency and the low temperature fluidity, and is preferably 1.000 $mm^2/s$ or more and 10.000 $mm^2/s$ or less, more preferably 1.500 $mm^2/s$ or more and 8.000 $mm^2/s$ or less, further preferably 2.000 $mm^2/s$ or more and 5.000 $mm^2/s$ or less, still further preferably 2.500 $mm^2/s$ or more and 4.000 $mm^2/s$ or less, and particularly preferably 2.800 $mm^2/s$ or more and 3.500 $mm^2/s$ or less.

(Viscosity Index)

The viscosity index of the lubricating oil composition of the present embodiment is preferably the lower limit value described below or more for balancing the fuel efficiency with a low viscosity and a low traction coefficient, the wear resistance, the usability with a high flash point, and the low temperature fluidity at a high level, is preferably the upper limit value described below or less for the easiness in availability and the like of the raw materials while the upper limit value is not particularly limited, and is preferably 80 or more and 140 or less, more preferably 90 or more and 140 or less, further preferably 100 or more and 138 or less, still further preferably 110 or more and 135 or less, and particularly preferably 120 or more and 130 or less.

(BF Viscosity at −40° C.)

The Brookfield viscosity (BF viscosity) at −40° C. of the lubricating oil composition of the present embodiment is preferably the upper limit value described below or less for improving the fuel efficiency and the low temperature fluidity, is preferably the lower limit value described below or more for the easiness in availability and the like of the raw materials while the lower limit value is not particularly limited, and is preferably 800 mPa·s or more and 10,000 mPa·s or less, more preferably 1,000 mPa·s or more and 5,000 mPa·s or less, further preferably 1,200 mPa·s or more and 2,000 mPa·s or less, still further preferably 1,400 mPa·s or more and 1,800 mPa·s or less, and particularly preferably 1,480 mPa·s or more and 1,650 mPa·s or less.

The BF viscosity is a value that is measured according to ASTM D2983-09.

(Flash Point)

The flash point of the lubricating oil composition of the present embodiment is preferably the lower limit value described below or more for the usability with a high flash point, is preferably the upper limit value described below or less for improving the fuel efficiency and the low temperature fluidity, and is preferably 180° C. or more and 210° C. or less, more preferably 184° C. or more and 205° C. or less, and further preferably 185° C. or more and 200° C. or less.

(Wear Resistance)

The wear resistance of the lubricating oil composition of the present embodiment can be evaluated, for example, by the wear width (mm) of the block after the block on ring wear test described in the examples.

The smaller the wear width is, the better the wear resistance is, and therefore the wear width is preferably small, and is preferably 1.000 mm or less, more preferably 0.900 mm or less, further preferably 0.880 mm or less, and still further preferably 0.870 mm or less, the lower limit value of which is not particularly limited.

(Traction Coefficient)

The traction coefficient of the lubricating oil composition of the present embodiment can be evaluated, for example, by the method described in the examples.

As described above, there is a relationship in which a larger traction coefficient is demanded for securing a large torque transmission capacity, but a large traction coefficient deteriorates the fuel efficiency.

For balancing the properties, the traction coefficient is preferably less than 0.004, and more preferably 0.003 or less, and the lower limit value thereof is not particularly limited.

[Lubricating Method and Transmission]

The lubricating oil composition of the present embodiment described above is excellent in the fuel efficiency with a low viscosity and a low traction coefficient, the wear resistance, the usability with a high flash point, and the low temperature fluidity, and therefore the lubricating method of the present embodiment is preferably applied to a driving system apparatus such as a damper, a transmission and a power steering, and particularly to a transmission, and can be applied particularly to a lubricating oil composition for a transmission of a gasoline automobile, a hybrid automobile, an electric automobile, and the like. Due to the excellent usability under a high temperature environment thereof, the lubricating method can be preferably applied to a lubricating oil composition for a hybrid automobile and an electric automobile.

The lubricating method of the present embodiment is a lubricating method including using the lubricating oil composition described above, and the transmission of the present embodiment is a transmission including the lubricating oil composition described above. The lubricating method including using the lubricating oil composition of the present embodiment and the transmission including the lubricating oil composition of the present embodiment as a constitutional component are excellent in the fuel efficiency with a low viscosity and a low traction coefficient, the wear resistance, the usability with a high flash point, and the low temperature fluidity.

Preferred examples of the other applications in which the lubricating oil composition of the present embodiment can be used include an internal combustion engine oil, a hydraulic oil, a turbine oil, a compressor oil, a lubricating oil for a machine tool, a cutting oil, a gear oil, a fluid composition for a fluid dynamic bearing, and a roller bearing oil.

According to one embodiment of the present invention, the following items [1] to are provided.

[1] A lubricating oil composition containing:

a base oil having a kinematic viscosity at 40° C. of 3.000 $mm^2/s$ or more and 20.000 $mm^2/s$ or less as a component (A); and a base oil having a kinematic viscosity at 40° C. of 100.000 $mm^2/s$ or more and 2000.000 $mm^2/s$ or less as a component (B), the component (A) having a flash point of 180° C. or more, and the lubricating oil composition having a content of the component (B) of 0.01% by mass or more and 2.00% by mass or less based on the total amount of the lubricating oil composition.

[2] The lubricating oil composition according to the item [1], wherein the lubricating oil composition has a total content of the component (A) and the component (B) of 70.00% by mass or more based on the total amount of the lubricating oil composition.

[3] The lubricating oil composition according to the item [1] or [2], in which the component (A) is a mineral oil, and the component (B) is a synthetic oil.

[4] The lubricating oil composition according to any one of the items [1] to [3], in which the component (A) has % $C_P$ of 84% or more.

[5] The lubricating oil composition according to any one of the items [1] to [4], in which the component (B) is at least one kind of a synthetic oil selected from a poly-α-olefin and an ester based base oil.

[6] The lubricating oil composition according to the item [5], in which the poly-α-olefin has a mass average molecular weight of 5,000 or more and 100,000 or less.

[7] The lubricating oil composition according to the item [5], in which the ester based base oil has a mass average molecular weight of 5,000 or more and 60,000 or less.

[8] The lubricating oil composition according to any one of the items [1] to [7], which further contains an anti-wear agent as a component (C).

[9] The lubricating oil composition according to the item [8], in which the component (C) is at least one kind selected from an acidic phosphate ester and a neutral phosphate ester, and the lubricating oil composition has a content of total phosphorus atoms contained in the lubricating oil composition of 10.0 ppm by mass or more 1000.0 ppm by mass or less based on the total amount of the lubricating oil composition.

[10] The lubricating oil composition according to any one of the items [1] to [9], which further contains a friction modifier as a component (D).

[11] The lubricating oil composition according to the item [10], in which the component (D) is at least one kind selected from an amide based friction modifier and an ester based friction modifier.

[12] The lubricating oil composition according to the item or [11], in which the lubricating oil composition has a total content of the component (B) and the component (D) of 0.01% by mass or more and 5.00% by mass or less based on the total amount of the lubricating oil composition.

[13] The lubricating oil composition according to any one of the items to [12], in which the lubricating oil composition has a value of a ratio of a content of the component (B) based on the total amount of the lubricating oil composition $C_B$ (% by mass) and a content of the component (D) based on the total amount of the lubricating oil composition $C_D$ (% by mass) ($C_B/C_D$) of 0.50 or more and 20.00 or less.

[14] The lubricating oil composition according to any one of the items [1] to [13], in which the lubricating oil composition is applied to a transmission.

[15] A lubricating method including using the lubricating oil composition according to any one of the items [1] to [13].

[16] A transmission including the lubricating oil composition according to any one of the items [1] to [13].

EXAMPLES

The present invention will be described in more detail with reference to examples below, but the present invention is not limited to the examples.

Examples 1 to 4 and Comparative Examples 1 to 6

Lubricating oil compositions were prepared according to the formulations shown in Table 1. The resulting lubricating oil compositions each were subjected to the tests for evaluating the properties thereof. The evaluation results are shown in Tables 1 and 2.

The properties of the lubricating oil composition were measured by the following methods.

(1) Kinematic Viscosity

The kinematic viscosities at 40° C. and 100° C. (i.e., the 40° C. kinematic viscosity and the 100° C. kinematic viscosity) were measured according to ASTM D455.

(2) Viscosity Index (VI)

The viscosity index was measured according to ASTM D2270.

(3) Brookfield Viscosity (BF Viscosity)

The BF viscosity at −40° C. of the transmission lubricating oil composition was measured according to ASTM D2983-09.

A results of 2000 or more was determined to be rejected.

(4) Flash Point

The flash point was measured with a Cleveland open-cup (COC) method testing machine according to JIS K2274.

A result of less than 180° C. was determined to be rejected.

(5) Wear Resistance

A block on ring wear test was performed by using H-60 as a block and S10 as a ring at an oil temperature of 80° C., a rotation number of 1092 rpm, a load of 1112 N, and a testing time of 20 minutes, according to ASTM D2714-94 (2003), and the wear width (mm) of the block after the test was measured and designated as an evaluation of the wear resistance. The unmeasurable case due to seizing occurring during the measurement is shown as "seizing".

A result of 0.900 mm or more was determined to be rejected.

(6) Traction Coefficient

The traction coefficient was measured with an MTM (mini traction machine) tester under the following condition.

Tester: MTM (mini traction machine), manufactured by PCS Instruments, Ltd.

Test piece: standard test piece (AISI 52100)

Load: 30 N

Oil temperature: 120° C.

Slide roll ratio (SRR): 5%

Rubbing (break-in) condition: rolling speed: 100 mm/s, sliding speed: 50 mm/s

Traction coefficient evaluation condition: rolling speed: 2 mm/s, sliding speed: 2.50 mm/s The traction coefficient was measured immediately after starting the test (0 minute), after 10 minutes, after 20 minutes, after 30 minutes, after 60 minutes, after 90 minutes, after 120 minutes, after 180 minutes, and after 240 minutes, corresponding to the rubbing time.

A result of 0.004 was determined to be rejected.

(7) Content of Phosphorus Atom

The content of a phosphorus atom was measured according to ASTM D4951.

(8) Content of Sulfur Atom

The content of a sulfur atom was measured according to ASTM D5453.

(9) Mass Average Molecular Weight (Mw)

The mass average molecular weight was measured by the GPC (gel permeation chromatography) method in terms of standard polystyrene conversion value. Specifically, the measurement was performed with the following equipment under the following condition.

GPC apparatus: Waters 1515 Isocratic HPLC Pump and Waters 2414 Refractive Index Detector, all manufactured by Waters Corporation Columns: two columns, TSKgel SuperMultiporeHZ-M, manufactured by Tosoh Corporation, connected Column temperature: 40° C.

Eluent: tetrahydrofuran

Flow rate: 0.35 mL/min

Detector: refractive index detector

TABLE 1

| | | | Example 1 | Example 2 | Example 3 | Example 4 |
|---|---|---|---|---|---|---|
| Component (A) | Mineral oil 1 | % by mass | 90.17 | | | |
| | Mineral oil 2 | % by mass | | 90.40 | 90.40 | |
| | Mineral oil 3 | % by mass | | | | 90.17 |
| | Mineral oil 4 | % by mass | | | | |
| | Mineral oil 5 | % by mass | | | | |
| Component (B) | PAO | % by mass | 1.00 | 1.00 | | 1.00 |
| | Ester 1 | % by mass | | | 1.00 | |
| | Ester 2 | % by mass | | | | |
| Component (C) | Acidic phosphate ester | ppm by mass *1 | 150.0 | 150.0 | 150.0 | 150.0 |
| | Neutral phosphate ester | ppm by mass *1 | 150.0 | 150.0 | 150.0 | 150.0 |
| Component (D) | Friction modifier | % by mass | 0.30 | 0.30 | 0.30 | 0.30 |
| Additional additives | | | balance | balance | balance | balance |
| | Total | | 100.00 | 100.00 | 100.00 | 100.00 |
| | Total phosphorus atom content | ppm by mass | 300.0 | 300.0 | 300.0 | 300.0 |
| | Total sulfur atom content | ppm by mass | 700.0 | 700.0 | 700.0 | 700.0 |
| | (A) + (B) | % by mass | 91.17 | 91.4 | 91.4 | 91.17 |
| | (B) + (D) | % by mass | 1.30 | 1.30 | 1.30 | 1.30 |
| | $C_B/C_D$ | | 3.33 | 3.33 | 3.33 | 3.33 |
| | $C_A/C_B$ | | 90.17 | 90.40 | 90.40 | 90.17 |
| | $C_A/C_D$ | | 300.57 | 301.33 | 301.33 | 300.57 |
| | $C_D/(C_A + C_B)$ | | 0.0033 | 0.0033 | 0.0033 | 0.0033 |
| | $(C_B + C_D)/C_A$ | | 0.0144 | 0.0144 | 0.0144 | 0.0144 |
| Properties | 40° C. Kinematic viscosity | $mm^2/s$ | 12.470 | 11.830 | 11.510 | 12.440 |
| | 100° C. Kinematic viscosity | $mm^2/s$ | 3.224 | 3.109 | 3.040 | 3.224 |
| | VI | | 129 | 126 | 124 | 129 |
| | BF viscosity | mPa · s | 1510 | 1510 | 1520 | 1600 |
| | Flash point | ° C. | 194 | 186 | 186 | 186 |
| Effects | Wear resistance | mm | 0.851 | 0.861 | 0.862 | 0.823 |
| | Traction coefficient | | 0.003 | 0.003 | 0.003 | 0.003 |

TABLE 2

| | | | Comparative Example 1 | Comparative Example 2 | Comparative Example 3 | Comparative Example 4 | Comparative Example 5 | Comparative Example 6 |
|---|---|---|---|---|---|---|---|---|
| Component (A) | Mineral oil 1 | % by mass | 91.17 | | | | | |
| | Mineral oil 2 | % by mass | | | | | | |
| | Mineral oil 3 | % by mass | | 91.17 | | | 86.19 | 90.17 |
| | Mineral oil 4 | % by mass | | | 90.17 | | | |
| | Mineral oil 5 | % by mass | | | | 90.17 | | |
| Component (B) | PAO | % by mass | | | | | | |
| | Ester 1 | % by mass | | | 1.00 | 1.00 | 5.00 | |
| | Ester 2 | % by mass | | | | | | 1.00 |
| Component (C) | Acidic phosphate ester | ppm by mass *1 | 150.0 | 150.0 | 150.0 | 150.0 | 150.0 | 150.0 |
| | Neutral phosphate ester | ppm by mass *1 | 150.0 | 150.0 | 150.0 | 150.0 | 150.0 | 150.0 |
| Component (D) | Friction modifier | % by mass | 0.30 | 0.30 | 0.30 | 0.30 | 0.30 | 0.30 |
| Additional additives | | | balance | balance | balance | balance | balance | balance |
| | Total | | 100.00 | 100.00 | 100.00 | 100.00 | 100.00 | 100.00 |
| | Total phosphorus atom content | ppm by mass | 300.0 | 300.0 | 300.0 | 300.0 | 300.0 | 300.0 |
| | Total sulfur atom content | ppm by mass | 700.0 | 700.0 | 700.0 | 700.0 | 700.0 | 700.0 |
| | (A) + (B) | % by mass | 91.17 | 91.17 | 91.17 | 91.17 | 91.19 | 91.17 |
| | (B) + (D) | % by mass | 0.30 | 0.30 | 1.30 | 1.30 | 5.30 | 1.30 |
| | $C_B/C_D$ | | — | — | 3.33 | 3.33 | 16.67 | 3.33 |
| | $C_A/C_B$ | | — | — | 90.17 | 90.17 | 17.24 | 90.17 |
| | $C_A/C_D$ | | 303.9 | 303.9 | 300.6 | 300.6 | 287.3 | 300.6 |
| | $C_D/(C_A + C_B)$ | | 0.0033 | 0.0033 | 0.0033 | 0.0033 | 0.0033 | 0.0033 |
| | $(C_B + C_D)/C_A$ | | 0.0033 | 0.0033 | 0.0144 | 0.0144 | 0.0615 | 0.0144 |
| Properties | 40° C. Kinematic viscosity | $mm^2/s$ | 11.910 | 12.470 | 12.470 | 12.400 | 14.810 | 12.410 |
| | 100° C. Kinematic viscosity | $mm^2/s$ | 3.110 | 3.188 | 3.209 | 3.228 | 3.710 | 3.230 |
| | VI | | 124 | 122 | 125 | 130 | 143 | 130 |
| | BF viscosity | mPa · s | 1450 | 1600 | 1760 | 2160 | 2000 | 1550 |
| | Flash point | ° C. | 194 | 180 | 180 | 176 | 190 | 190 |
| Effects | Wear resistance | mm | 0.931 | seizing | 0.810 | 0.898 | 0.820 | 0.930 |
| | Traction coefficient | | 0.004 | 0.003 | 0.004 | 0.004 | 0.003 | 0.003 |

*1: The content (ppm by mass) of the component (C) shows the content of the component (C) in terms of phosphorus atom based on the total amount of the lubricating oil composition.

The abbreviations in the tables show the following.

Mineral oils 1 to 5 are mineral oils having the following property values.

TABLE 3

| | | Mineral oil 1 | Mineral oil 2 | Mineral oil 3 | Mineral oil 4 | Mineral oil 5 |
|---|---|---|---|---|---|---|
| Density | g/cm$^3$ | 0.8100 | 0.8125 | 0.8146 | 0.8193 | 0.8311 |
| 40° C. Kinematic viscosity | mm$^2$/s | 9.934 | 9.457 | 9.892 | 9.895 | 9.875 |
| 100° C. Kinematic viscosity | mm$^2$/s | 2.705 | 2.612 | 2.700 | 2.694 | 2.686 |
| VI | | 112 | 110 | 112 | 111 | 110 |
| Flash point COC | ° C. | 194 | 186 | 186 | 176 | 170 |
| Pour point | ° C. | −40 | −40 | −35 | −32.5 | −27.5 |
| Mw | | 311 | 304 | 311 | 310 | 309 |
| % $C_P$ | | 90.4 | 87.7 | 86.6 | 82.6 | 72.9 |
| % $C_N$ | | 9.4 | 11.9 | 13.2 | 17.3 | 27.2 |
| % $C_A$ | | 0.2 | 0.4 | 0.1 | 0.1 | −0.1 |

In the tables, PAO (poly-α-olefin), Ester 1 (ester based base oil), and Ester 2 (ester based base oil) are synthetic oils having the following property values.

TABLE 4

| | | PAO | Ester 1 | Ester 2 |
|---|---|---|---|---|
| Density | g/cm$^3$ | 0.848 | 0.910 | 0.869 |
| 40° C. Kinematic viscosity | mm$^2$/s | 1616.000 | 270.000 | 8.200 |
| 100° C. Kinematic viscosity | mm$^2$/s | 147.000 | — | 2.600 |
| Pour point | ° C. | −37.5 | — | — |
| Mw | | 66,000 | 13,000 | 394 |

Acidic phosphate ester: acidic phosphate ester having octyl group as side chain

Neutral phosphate ester: tricresyl phosphate

Friction modifier: Isostearic amide in an amount of 0.10% by mass based on the total amount of the lubricating oil composition and a fatty acid polyhydric alcohol ester in an amount of 0.20% by mass based on the total amount of the lubricating oil were added.

Additional additives: antioxidant, detergent, dispersant, pour point depressant, anti-foaming agent, etc.

As apparent from the results in Table 1, the lubricating oil compositions of Examples 1 to 4 were excellent in the fuel efficiency with a low viscosity and a low traction coefficient, the wear resistance, the usability with a high flash point, and low temperature fluidity.

On the other hand, the composition of Comparative Example 1 containing no component (B) had a traction coefficient that was 1.3 times the compositions of Examples, and was inferior in the fuel efficiency.

The composition of Comparative Example 2 was a composition obtained by replacing the component (A) from the composition of Comparative Example 1, and the composition had a low flash point, and caused seizing in the wear resistance test, failing to measure the wear width.

The compositions of Comparative Examples 3 and 4 were compositions containing the mineral oil 4 or 5, which were mineral oils having a flash point of less than 180° C., and the use of these mineral oils lowered the flash point and increased the traction coefficient, resulting in the inferior fuel efficiency.

The composition of Comparative Example 5 was a composition obtained by increasing the content of the component (B) of the composition of Example 4, and the increase of the content of the component (B) beyond 2% by mass caused a large BF viscosity at −40° C. as compared to the compositions of Examples, resulting in the inferior low temperature fluidity.

The composition of Comparative Example 6 was a composition obtained by replacing the component (B) of the composition of Example 4 by the ester compound having a kinematic viscosity at 40° C. of 8.200 mm$^2$/s, and the composition was inferior in the wear resistance.

It is understood from the above that the use of the component (A) having the particular flash point and the particular amount of the component (B) contained can provide a lubricating oil composition that satisfies the fuel efficiency with a low viscosity and a low traction coefficient, the wear resistance, the usability with a high flash point, and the low temperature fluidity, at high levels.

The invention claimed is:

1. A lubricating oil composition, comprising:

a first base oil having a kinematic viscosity in a range of 3.000 mm$^2$/s to 20.000 mm$^2$/s at 40° C. and having a flash point of 180° C. or more; and a second base oil having a kinematic viscosity in a range of 100.000 mm$^2$/s to 2000.000 mm$^2$/s at 40° C. and comprising at least one synthetic oil selected from the group consisting of a poly-α-olefin obtained by polymerizing an α-olefin of 8 to 12 carbon atoms and an ester based base oil, wherein the lubricating oil composition comprises a content of the second base oil in a range of 0.01% by mass to 2.00% by mass based on a total amount of the lubricating oil composition.

2. The lubricating oil composition according to claim 1, wherein the lubricating oil composition has a total content of the first base oil and the second base oil of 70.00% by mass or more based on a total amount of the lubricating oil composition.

3. The lubricating oil composition according to claim 1, wherein the first base oil is a mineral oil.

4. The lubricating oil composition according to claim 1, wherein the first base oil has a % CP of 84% or more.

5. The lubricating oil composition according to claim 1, wherein the synthetic oil is the poly-α-olefin, and the poly-α-olefin has a mass average molecular weight in a range of 5,000 to 100,000.

6. The lubricating oil composition according to claim 1, wherein the synthetic oil is the ester based base oil, and the ester based base oil has a mass average molecular weight in a range of 5,000 to 60,000.

7. The lubricating oil composition according to claim 1, further comprising:

an anti-wear agent.

8. The lubricating oil composition according to claim 7, wherein the anti-wear agent is at least one selected from the group consisting of an acidic phosphate ester and a neutral phosphate ester, and the lubricating oil composition has a content of total phosphorus atoms contained in the lubricating oil composition in a range of from 10.0 ppm by mass to 1000.0 ppm by mass based on a total amount of the lubricating oil composition.

9. The lubricating oil composition according to claim 1, further comprising:

a friction modifier.

10. The lubricating oil composition according to claim 9, wherein the friction modifier is at least one selected from the group consisting of an amide based friction modifier and an ester based friction modifier.

11. The lubricating oil composition according to claim 9, wherein the lubricating oil composition has a total content of the second base oil and the friction modifier in a range of 0.01% by mass to 5.00% by mass based on a total amount of the lubricating oil composition.

12. The lubricating oil composition according to claim 9, wherein the lubricating oil composition has a ratio CB/CD in a range of 0.50 to 20.00, which is a ratio of a content CB in % by mass of the second base oil based on a total amount of the lubricating oil composition to a content CD in % by mass of the friction modifier based on the total amount of the lubricating oil composition.

13. A lubricating method, comprising:

applying the lubricating oil composition of claim 1.

14. A transmission, comprising:

the lubricating oil composition of claim 1.

15. The lubricating method of claim 13, wherein the lubricating oil composition is applied to a transmission.

16. The lubricating oil composition according to claim 1, wherein the content of total sulfur atoms is 600 ppm to 800 ppm.

17. The lubricating oil composition according to claim 1, wherein the lubricating oil composition has a kinematic viscosity at 40°° C. of 3.000 $mm^2/s$ to 50.000 $mm^2/s$.

18. The lubricating oil composition according to claim 1, wherein the lubricating oil composition has a kinematic viscosity at 40°° C. of 3.000 $mm^2/s$ to 20.000 $mm^2/s$.

19. The lubricating oil composition according to claim 1, wherein the lubricating oil composition has a kinematic viscosity at 40°° C. of 3.000 $mm^2/s$ to 13.000 $mm^2/s$.

* * * * *